United States Patent [19]

Jeffery

[11] 4,174,266

[45] Nov. 13, 1979

[54] METHOD OF OPERATING AN ELECTROLYTIC CELL HAVING AN ASBESTOS DIAPHRAGM

[75] Inventor: Thomas C. Jeffery, Lake Charles, La.

[73] Assignee: PPG Industries, Inc., Pittsburgh, Pa.

[21] Appl. No.: 931,633

[22] Filed: Aug. 7, 1978

Related U.S. Application Data

[60] Division of Ser. No. 744,309, Mar. 4, 1977, which is a continuation-in-part of Ser. No. 695,626, Jun. 14, 1976, which is a continuation-in-part of Ser. No. 577,270, May 14, 1975, abandoned.

[51] Int. Cl.[2] ..... C25B 1/16; C25B 1/26

[52] U.S. Cl. ..... 204/98; 204/128

[58] Field of Search ..... 204/98, 128

[56] References Cited

U.S. PATENT DOCUMENTS

| | | |
|---|---|---|
| 1,372,118 | 3/1921 | Collier . |
| 3,755,108 | 8/1973 | Raetzsch et al. . |
| 3,809,630 | 5/1974 | De Nora et al. . |
| 3,855,091 | 12/1974 | Piester . |

*Primary Examiner*—R. J. Andrews

*Attorney, Agent, or Firm*—Richard M. Goldman

[57] ABSTRACT

Disclosed is an electrolysis cell and method of operation in which metal anodes (preferably titanium) provided with an electrically conducting electrocatalytic coating in an anode compartment face diaphragm covered metal cathodes in a cathode compartment, in which the anodes are spaced from an imperforate valve metal separating partition by a separating wall behind which the anolyte can recirculate downward, the anodic gases rising in the anode compartment "gently" circulate the anolyte and the gases are discharged into a brine box above the anode compartment near the center thereof and the anolyte recirculates downward near at least one end of the anode compartment; and a method of operation which provides circulation from front to back of the anode compartment and from center to sides of the anode compartment and means for adding new diaphragm material to the circulating anolyte to deposit said new diaphragm material on the diaphragms and methods of determining when and how much new diaphragm material to add.

5 Claims, 22 Drawing Figures

8b
5k
8
8
5j
5j 5e
5h
5g
5i
5i 8b
8a
8b
8a
5

5h
5i
5g
C 5e
5h
5g
5i 5b
8
8a
5
8
5
8a
5b

FIG. 18
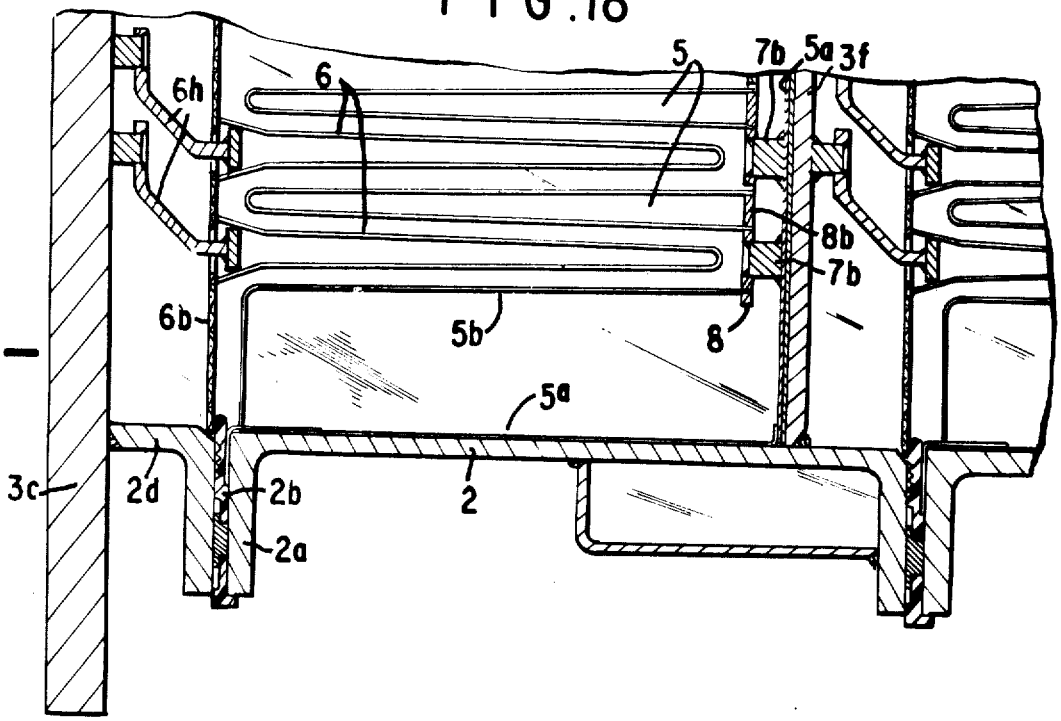
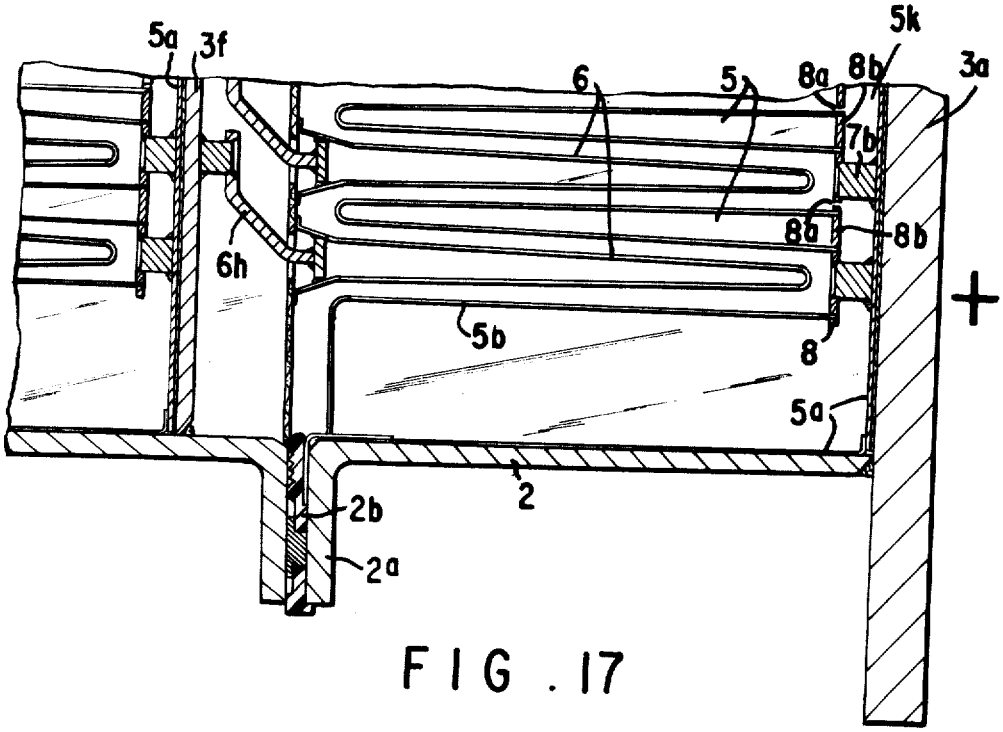
FIG. 17

METHOD OF OPERATING AN ELECTROLYTIC CELL HAVING AN ASBESTOS DIAPHRAGM

CROSS REFERENCE TO RELATED APPLICATIONS

This is a division of application Ser. No. 774,309, filed Mar. 4, 1977 and a continuation-in-part of my commonly assigned, copending U.S. application Ser. No. 695,626 filed June 14, 1976 for METHOD OF OPERATING AN ELECTROLYTIC CELL, which is in turn a continuation-in-part of my commonly assigned U.S. application Ser. No. 577,270 filed May 14, 1975 for METHOD OF OPERATING AN ELECTROLYTIC CELL, now abandoned.

DESCRIPTION OF THE INVENTION

This invention relates to electrolysis cells and methods of electrolysis as used, for example, for the electrolysis of alkali metal halides such as lithium, sodium and potassium chlorides, bromides and iodides and, more generally, for the electrolysis of halogenides and for the electrolysis of other salts which undergo electrolytic decomposition under electrolysis conditions, for the electrolysis of water to produce hydrogen and oxygen, for the electrolysis of sodium and potassium sulfate to produce caustic soda or caustic potash and sulfuric acid, for the electro-osmosis and electrodialysis, for organic oxidation and reduction reactions, and for other processes which may be carried out by electrolysis reactions which require the use of diaphragms between the electrodes. The invention will be described with reference to cells equipped with one diaphragm on the cathode side of the cell, but it will be understood that two diaphragms between the anodes and cathodes, one on the anode and one on the cathode, may be used for special applications.

The cell and method will be described for the electrolysis of sodium chloride to produce chlorine and caustic soda, but this is only for the purpose of illustrating the invention. It will also be described as a multiple unit bipolar cell, but it will be understood that it may be operated as individual units, either separately or connected together by intermediate connections.

One of the objects of this invention is to provide a new arrangement of electrodes in diaphragm electrolysis cells, in which anodic and cathodic reactions may be carried out more efficiently and over longer periods of time than in prior electrolysis cells, and to provide diaphragm cells which are easier and cheaper to construct and maintain in service and which have a longer life between dismantlings for diaphragm replacement and other repairs than prior electrolysis cells.

Another object is to provide electrolysis cells which have a greater recirculation of the electrolyte within the anolyte compartment than prior electrolysis cells, whereby new diaphragm material may be introduced and deposited on the diaphragms while the cells are in service.

Another object is to provide an electrolysis cell and process in which the electrolyte circulation through the cell provides more uniform electrolyte composition throughout the cells than prior electrolysis cells and prolongs the normal life of the diaphragms.

Another object is to provide an electrolysis cell in which diaphragm material may be added to the electrolyte and circulated through the electrolysis cell to deposit additional diaphragm material on the diaphragm as needed, and to provide means to make such additions.

Another object is to provide an electrolysis cell and process in which the electrolyte is circulated upwardly by the anodic gases in the interelectrodic gap between the anodes and cathodes and within the hollow fingers or waves of the anodes, and downwardly behind the anodes, and is also recirculated upwardly toward the center and downwardly toward at least one side of the cell, to thereby provide gentle circulation of the electrolyte from front to back and from the center to the sides of each cell unit to deposit new diaphragm material in the more porous areas of the diaphragms to maintain the diaphragms in service over longer periods of time.

Another object is to provide an electrolysis cell and process in which the anodic gases have a larger space in which to escape from the electrolysis gap and from the cell, with a minimum of obstruction against their escape, to thereby provide greater circulation of the electrolyte at a lower rate of flow within the cell.

Another object is to provide methods of monitoring cell performance, by which the addition of new diaphragm material may be correlated with cell performance data so that approximately just the right amount of new diaphragm material may be added to the circulating electrolyte.

Various other objects and advantages of this invention will appear as this description proceeds.

Referring now to the drawings, which show, for the purpose of illustration, one embodiment of electrolysis cells in which this invention may be practiced;

Figure 8:
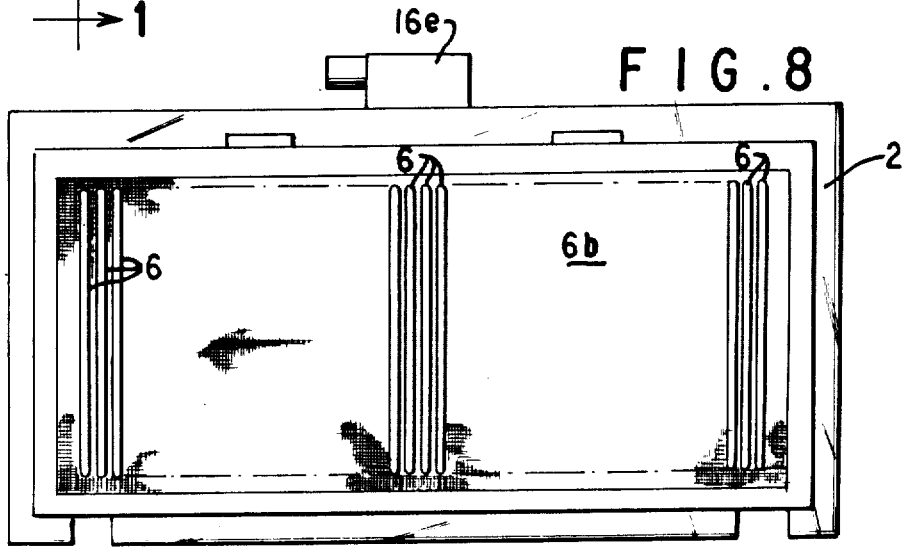
Figure 6:
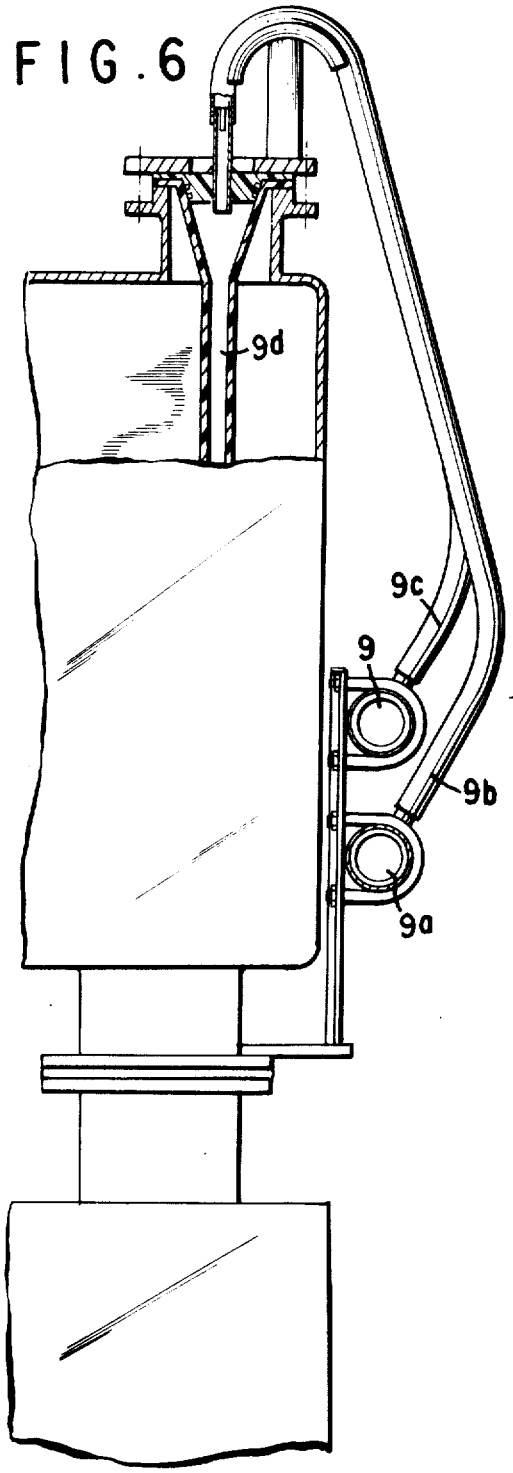
Figure 7:
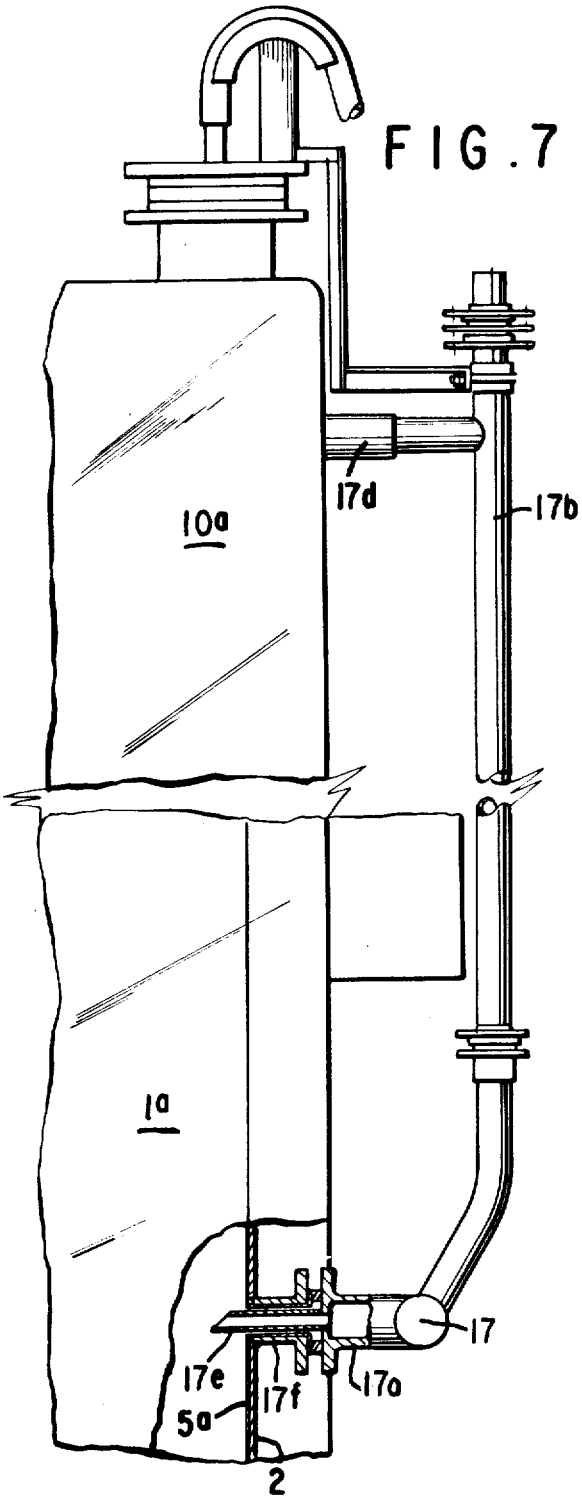
Figure 9:
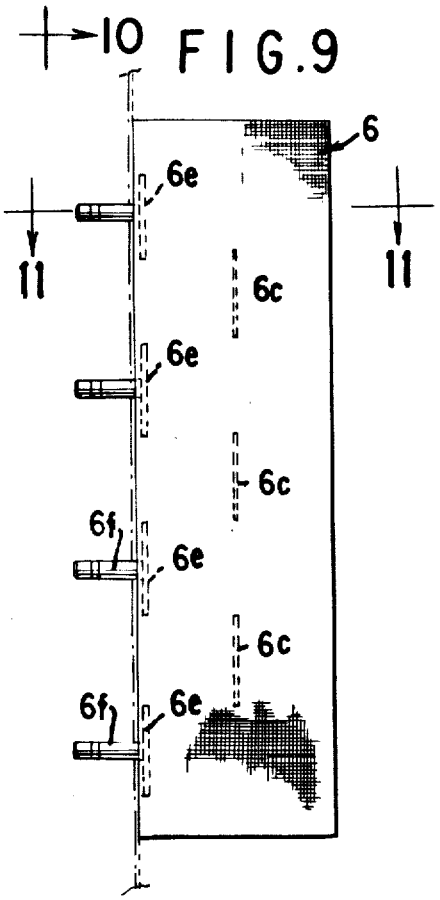
Figure 10:
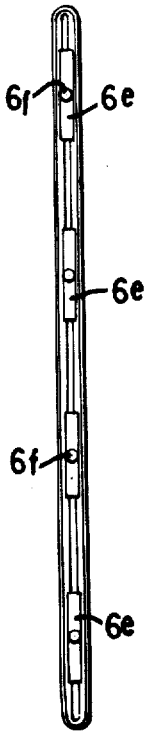
Figure 12:
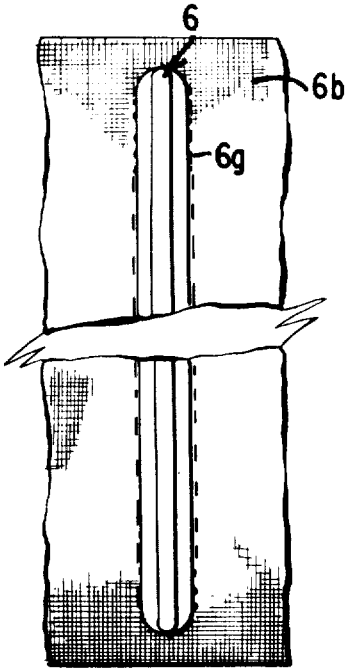
Figure 11:
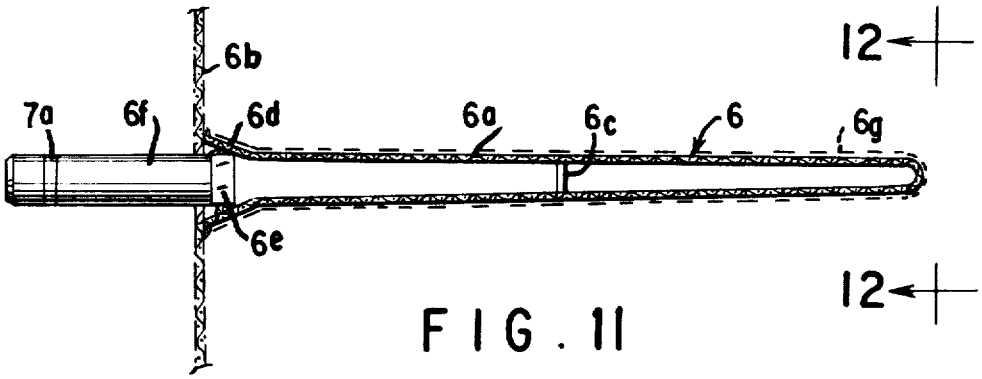
Figures 13, 13A, 14, 14A, 15, 16:
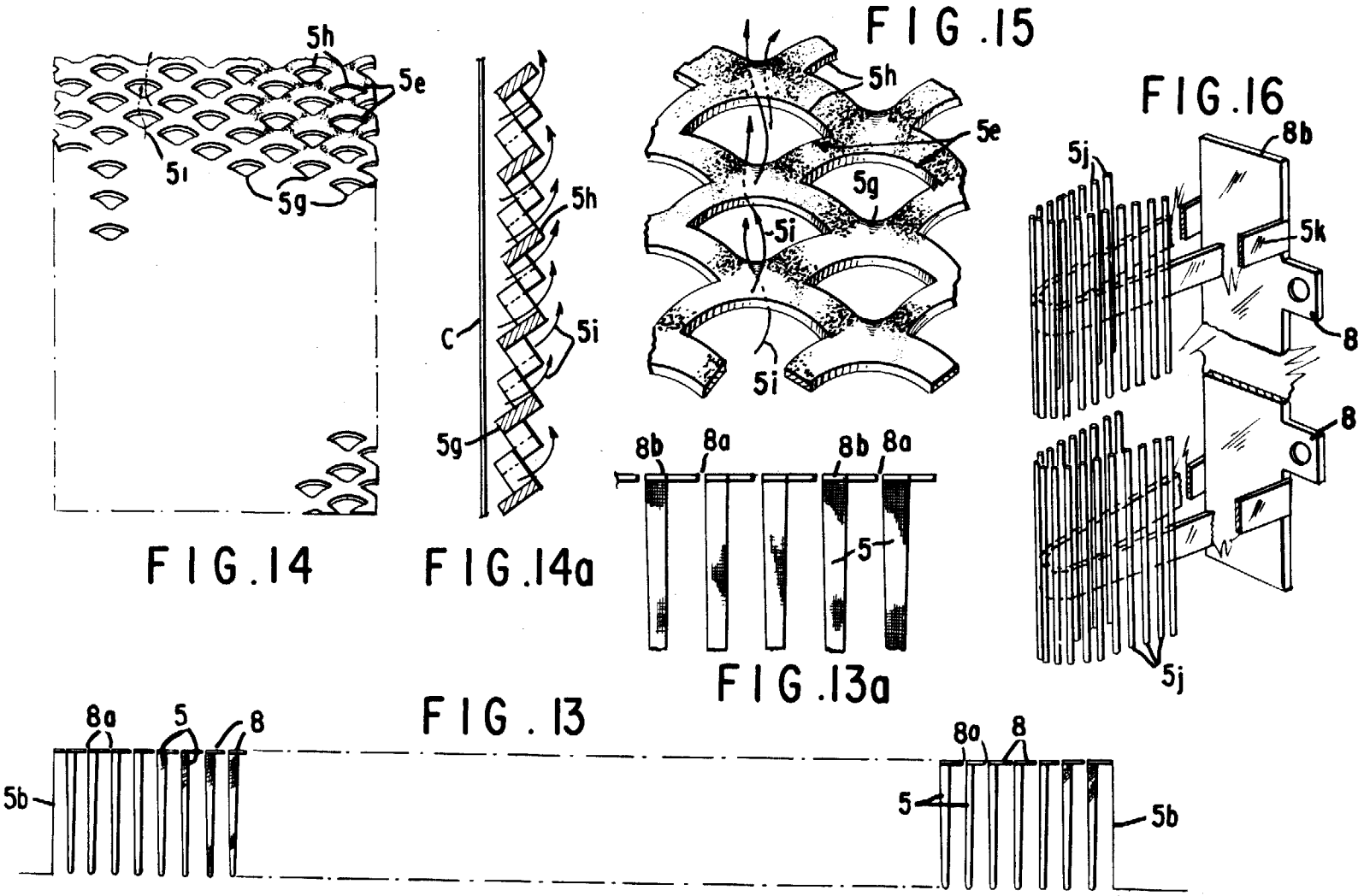

FIG. **5*a*** is a partial perspective view of two cell units with parts broken away;

FIG. 6 is a part-sectional view of the feed line assembly used in each cell unit;

FIG. 7 is a side view, partially in section, of the brine level equalizer and brine level indicator;

FIG. 8 (sheet 3) is a side view, partially in section, of a cathode end frame;

FIG. 9 is a side view of one of the cathode fingers;

FIG. 10 is a part-sectional end view of a cathode finger, substantially along the line 10—10 of FIG. 9;

FIG. 11 is a sectional plan view of a cathode finger, substantially along the line 11—11 of FIG. 9;

FIG. 12 is a face view of a cathode finger;

FIG. 13 is a plan view of an anode assembly and

Figure 19:
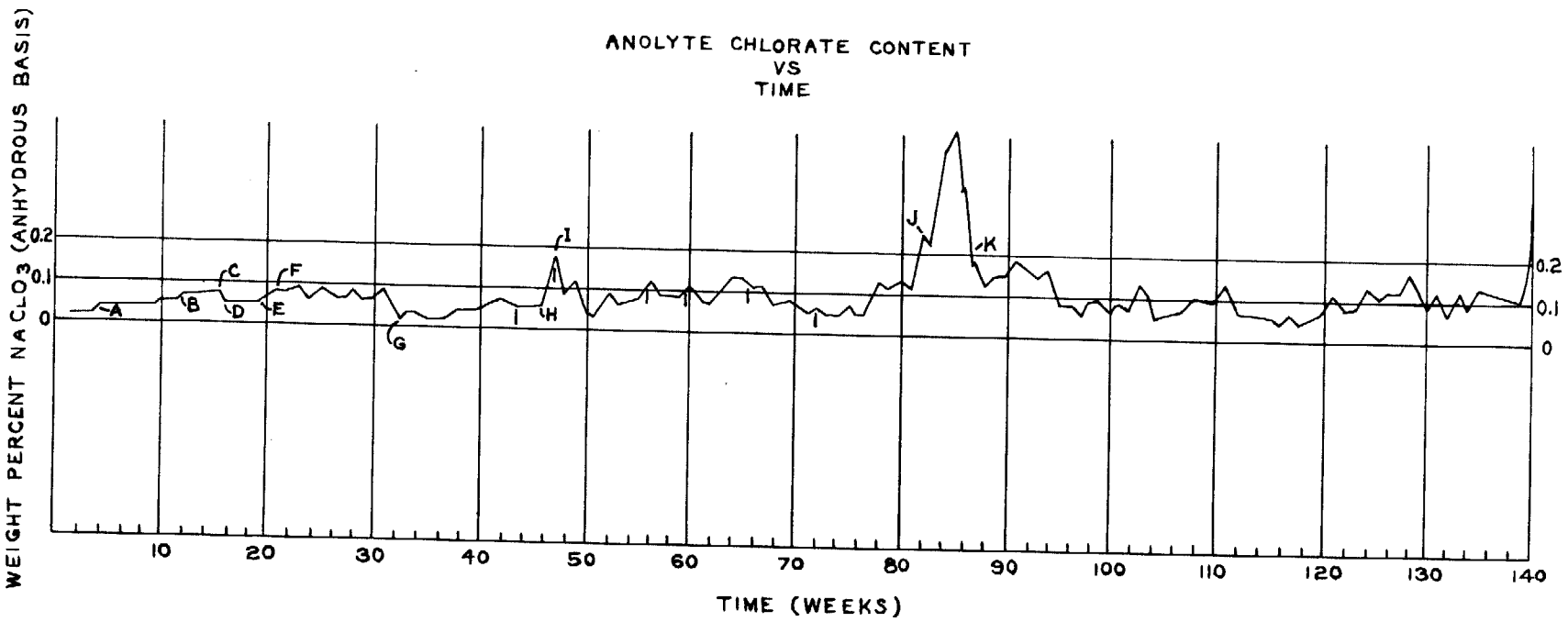

FIG. **13*a* is an enlarged area of FIG. 13**;

FIGS. 14, **14*a* and 15** are details of the anode wall construction;

FIG. 16 shows vertically mounted rod anodes;

FIG. 17 is a sectional plan view of the anode end of a modified cell construction;

FIG. 18 is a sectional plan view of the cathode end of the modified cell of FIG. 17; and FIG. 19 is a graph indicating the conditions under which new diaphragm material is added to the cells.

Figure 2:
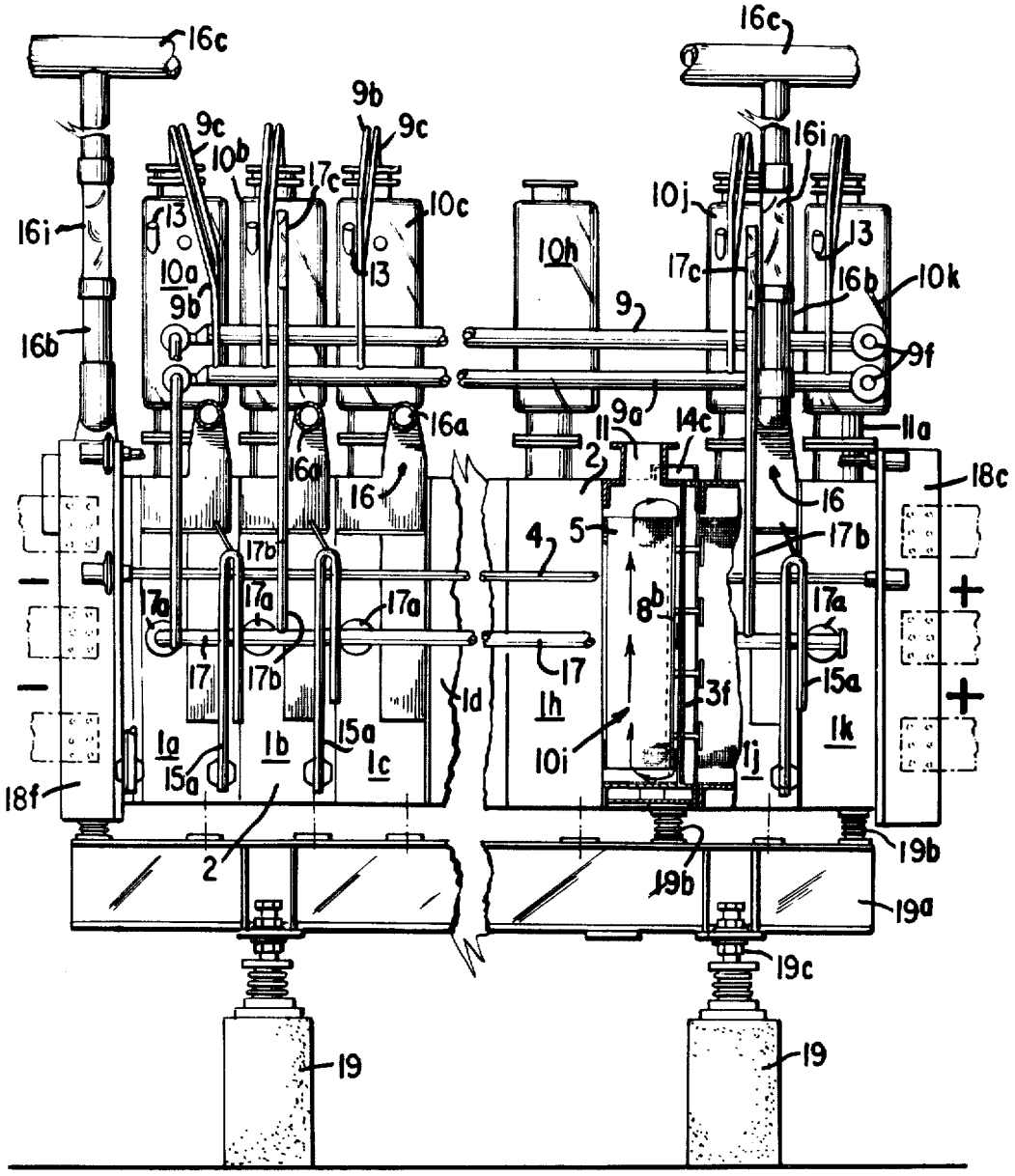
FIG. 2 is a part-sectional side view, with parts broken away and portions omitted, of the cell illustrated in FIG. 1.
Figure 4:
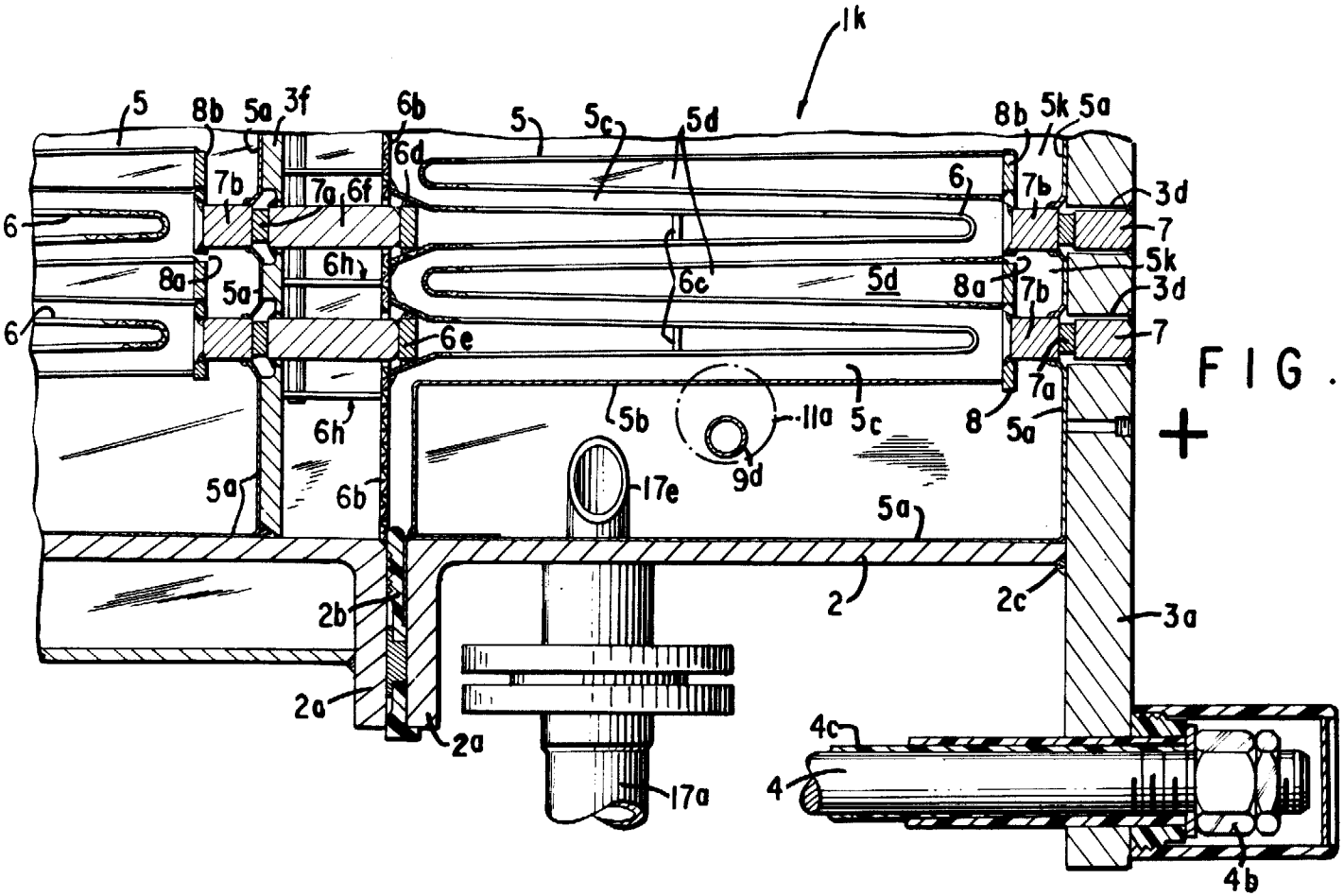
FIG. 4 is an enlarged sectional plan view of a portion of the bipolar cell unit at the anode end of the cell, showing one intermediate separating partition.
Figure 5:
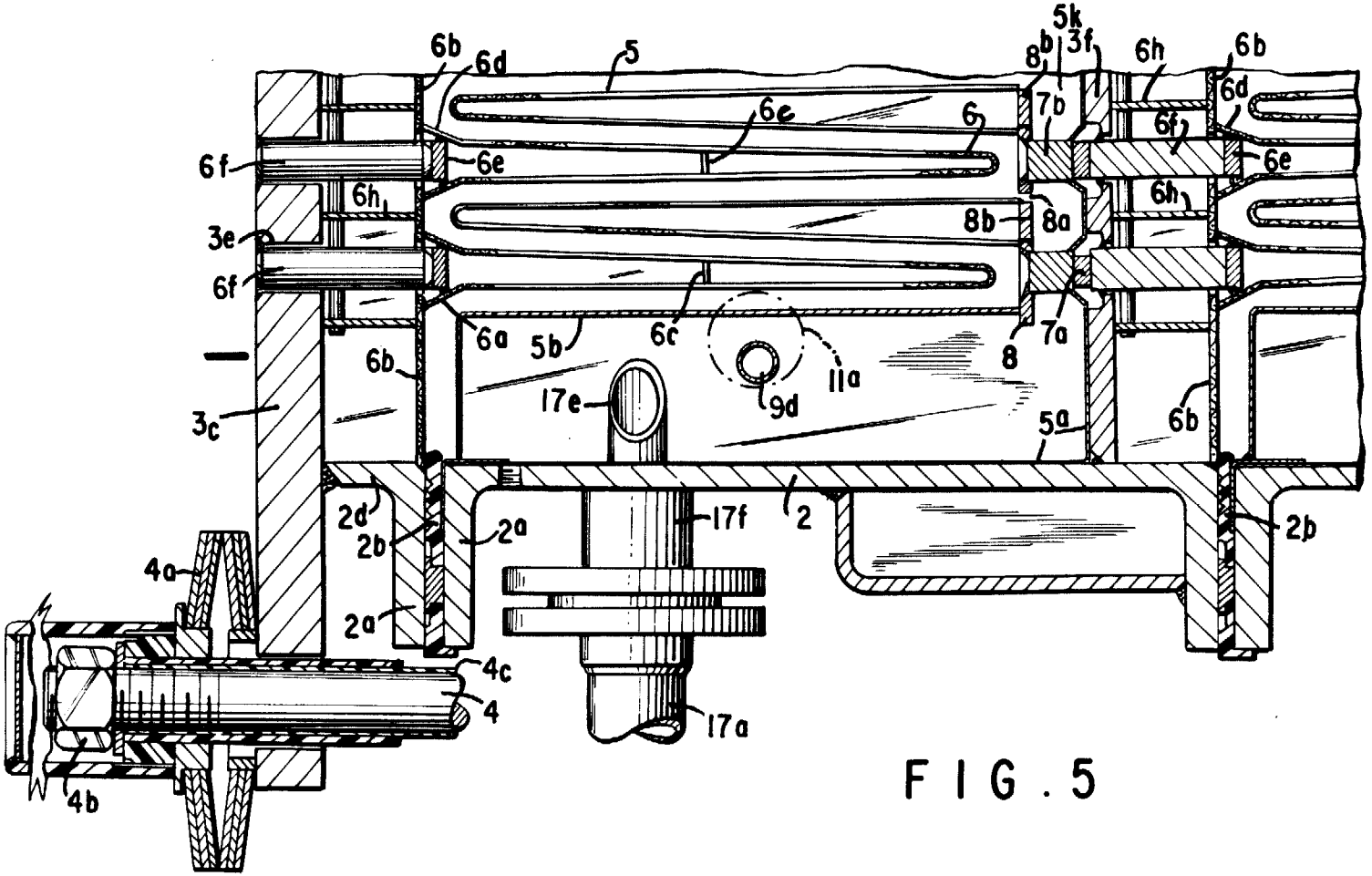
FIG. 5 is a cross-sectional plan view of a portion of a bipolar cell unit at the cathode end of the cell, showing one intermediate separating partition.

One embodiment of the bipolar cell in which this invention may be used comprises a plurality of rectangular cell units, $1^a$–$1^b$–$1^c$–$1^h$–$1^i$–$1^j$–$1^k$, etc. (FIG. 2). The number of cell units may vary according to the capacity desired. The embodiment illustrated comprises ten bipolar cell units, an anode end element and a cathode end element, making eleven individual cell units in bipolar connection. The number of such units may be larger or smaller than illustrated. Each cell unit has a brine box, $10^a$, $10^b$, $10^c$, $10^d$, $10^e$, $10^i$, $10^j$, $10^k$, preferably mounted on the top thereof (FIG. 3), although the brine boxes may be suspended above the cell units and connected thereto. Any cell unit may be used as a single unipolar cell and current connection between one or more separate unipolar cell units may be provided. Each cell unit is mounted in a rectangular metal frame 2, with end flanges 2*a* (FIGS. 4, 5 and 5*a*), which abut against similar end flanges of the adjacent cell frames 2. Suitable insulating gaskets 2*b* are provided between the flanges of each intermediate frame unit which, together with the long bolts 4, maintain the assembled cell units in fluid-tight connection. The frame 2 of the anode end element $1^k$ is welded or otherwise secured to the anode end plate $3^a$, as illustrated at $2^c$ in FIG. 4. The flanges $2^a$ of the rectangular frame 2, adjacent the cathode end element $1^a$ abuts against a flanged cathode end frame $2^d$, with an insulating gasket $2^b$ between each set of flanges $2^a$, as shown in FIG. 5. The flanged cathode end frame $2^d$ is welded or otherwise secured to the cathode end plate $3^c$.

The assembly of cell units is held together by a plurality of long bolts 4 covered with plastic sleeves $4^c$ and suitably insulated from the end plates $3^a$ and $3^c$. The cathode end of each long bolt 4 is provided with spring washers $4^a$ and detachable nuts $4^b$, as illustrated in FIGS. 4 and 5. The long bolts are spaced from the rectangular frames 2 and flanges $2^a$.

The intermediate units of the bipolar cell illustrated are all substantially the same. The anode end element and the cathode end element of each cell assembly differ from the intermediate units in the construction necessary to secure the positive electrical connections to the anode end and the negative connections for the cathode end of the cell assembly, and in other details necessary at the end units more particularly as illustrated in FIGS. 4 and 5.

Each rectangular frame 2 houses a series of anodes 5 and cathodes 6 within the frame 2. The anodes 5 and cathodes 6 are preferably in nested, hollow finger or wave form, as illustrated in FIGS. 4 and 5 (also FIGS. 13, 17 and 18), but may be flat plates or have other forms. The hollow wave form provides greater anode and cathode surface within the frames 2 than any other form. The anodes 5 are formed of a metal resistant to anodic conditions, such as titanium, tantalum, zirconium, niobium, or other valve or film-forming metal or alloys of these metals. The walls of each anode compartment, where exposed to the anolyte and anodic conditions, are lined with a corrosion-resistant lining, such as titanium or tantalum or alloys thereof $5^a$, or a suitable polyester or other resin plastic. The titanium, tantalum or other valve metal of the anodes 5 may be solid, reticulated, rod, screen or other open form. The anodes are coated on either the inside or outside, or both sides of the hollow fingers 5, with an electrically conducting electrocatalytic coating, such as one containing a platinum group metal or a platinum group metal oxide together with titanium and/or other metals or oxides as desired, such as described, for example, in U.S. Pat. Nos. 3,632,498 and 3,711,385.

The cathode fingers 6 are preferably formed of metal screen $6^a$ (FIGS. 5 and 11) and project from a metal screen backing $6^b$. The cathode waves or fingers are closed at the top and bottom with metal screen material. A suitable diaphragm of asbestos or an ion-permeable diaphragm material may be applied to the screens $6^a$ and $6^b$ by vacuum deposition or other methods to separate the anode compartment of each cell unit from the cathode compartment. Suitable reinforcements $6^c$ may be provided in the interior of the screen cathode fingers to prevent them from collapsing if the diaphragm material is deposited by vacuum on the screen fingers. The diaphragm material covers the side walls as well as the top and bottom of the cathode fingers 6 and the screen backing $6^b$. The diaphragms $6^g$ are only partially and diagramatically shown by the dash lines in FIGS. 11 and 12, but it will be understood that the fingers 6 and backing screens $6^b$ are completely covered with diaphragms. The backing screens $6^b$ are spaced from the cathode compartment end walls $3^c$ and $3^f$ by back screen supports $6^h$.

In chlorine production, for example, the diaphragms separate the anolyte compartments from the catholyte compartments and are intended to keep the gases formed in each of these compartments separate, as is well understood in the diaphragm cell art. In the case of chlorine and caustic production from a sodium chlorine brine, the diaphragms are intended to keep the chlorine released at the anode from mixing with the sodium hydroxide and hydrogen formed at the cathode. However, the separation of the anodic reaction products from the cathodic reaction products by the diaphragms is never perfect and there is some back migration of chlorate ions and hydroxyl through the diaphragms from the cathode chambers to the anode chambers, which reduces the anode current efficiency so that it is desirable to maintain the separation of the anodic and cathodic reaction products by the diaphragm as uniform as possible and to repair any portion of the diaphragms through which this leakage may occur as promptly as possible without taking the cell out of service.

In the electrolysis of sodium chloride brine to produce chlorine and caustic soda, it is desirable to have as perfect performance of the diaphragm as possible. The reaction which occurs at the anode is:

$$2Cl^- \rightarrow Cl_2 + 2e^- \quad (1)$$

while the reaction at the cathode is:

$$2H_2O + 2e^- \rightarrow 2H_2 + 2OH^-. \quad (2)$$

Due to imperfect separation of the anodic and cathodic reaction products, the following reactions also occur:

$$Cl_2 + OH^- \rightleftharpoons Cl^- + HOCl, \quad (3)$$

$$HOCl \rightleftharpoons H^+ + OCl^-, \text{ and} \quad (4)$$

$$2HOCl + OCl^- \rightleftharpoons ClO_3^- + 2Cl + 2H^+. \quad (5)$$

These reactions are believed to occur in the anolyte liquor. The overall product of these reactions is chlorate ion, $ClO_3^-$. The greater the concentration of chlorate ions in the anolyte liquor the greater the loss of anode current efficiency. The formation of hypochlorous acid, HOCl, is favored by a high pH in the anolyte liquor, as is the decomposition of a hypochlorous acid, HOCl, into hydrogen ion and hypochlorite ion, $OCl^-$. The hypochlorous acid and hypochlorite ion then combine to yield chlorate ion, $ClO_3^-$, as shown in equation (5). This reaction is also favored by a high pH. Thus, as is well known in the art, a high pH favors the formation of chlorate ion in the anolyte liquor, thereby resulting in a significant loss of anode current efficiency.

Also, a high pH increases the hydroxyl ion concentration in the anolyte. This results in oxygen evolution, according to equation (6);

$$4OH^- \rightarrow O_2 + 2H_2O + 4e^-, \quad (6)$$

which further reduces the anode current efficiency.

Therefore, suppression of diffusion of chlorate ions and hydroxyl ions from the catholyte liquor through the diaphragm into the anolyte liquor and of chlorine into the catholyte liquor and maintenance of the integrity and uniformity of the diaphragm are of extreme importance in the operation of a diaphragm cell, as will be described hereafter.

This type of cell, when used for chlorine-caustic soda production, usually operates at a current density of about 2045 amps/$m^2$ and a cell voltage in the individual cell units of about 3.40 to 3.60 volts. The anolyte compartments are operated as completely flooded except for any anolyte gas bubbles which may be moving under the cell cover, which makes uniformity of diaphragm performance all the more important.

The anode waves or fingers 5 and the individual cathode fingers 6 are separately formed, assembled and welded to a series of spaced anode support bars $8^b$ and to the cathode back screens $6^b$, respectively, and prior to assembly, the cathode fingers 6 and cathode back screens $6^b$ are provided with a diaphragm covering. The anode support bars $8^b$ are connected by means of a series of spaced titanium assembly lugs 8 to titanium studs $7^b$ connected to the titanium lining $5^a$ of the anode compartments, preferably by welding. This permits separate manufacture and assembly of the individual anodes and cathodes and co-alignment of the composite connector rods formed by 7, $7^a$, $7^b$, $6^f$, etc., extending between the anodes and cathodes, which produces better conduction and reduces resistance losses in the cells.

The anode end plate $3^a$ is provided with a series of rows of circular openings $3^d$. Pre-assembled composite connector rods formed by a steel plug 7, a copper insert $7^a$, and a titanium stud $7^b$, preferably welded together by friction welding, are welded into holes $3^d$ as shown in FIG. 4. The titanium lining $5^a$ of the anode compartment is welded to the titanium studs $7^b$, as shown in FIG. 4, and titanium anode supports 8, are welded to the titanium studs $7^b$. Anode support bars $8^b$, extending substantially for the entire height of the anode fingers are secured through the assembly lugs 8 to the titanium studs $7^b$ and form a wall, dividing the interior of the anode compartments into a front portion housing the anode fingers 5, and a rear portion $5^k$, behind the anode of fingers into which the anolyte which has been brought to the top of the anode fingers 5 by the gas lift effect of the anodic gases in the front portion of the anode compartment can be recirculated downward in the spaces $5^k$ to the bottom of the anode compartment. A small gap $8^a$, is left between the anode supports 8 and the anode support bars $8^b$ which together with the openings between the spaced assembly lugs 8 allow restricted flow of anolyte between the front and the back of the anode compartments. The gaps $8^a$ and the spaces between the anode assembly lugs 8 are relatively small as compared to the solid areas of the anode support bars and the assembly lugs 8. The ratio of solid walls $8^b$ to the openings $8^a$ is about 6 to 1. This ratio is, however, not critical and the ratio between the solid area and the open area of the separating walls may be slightly larger or smaller.

The reticulated titanium fingers 5 are welded at each side of the base of the fingers 5 to the anode support bars $8^b$. Only two anode fingers 5, one anode finger end wall $5^b$, and two anode support lugs 8 are shown in FIG. 4, but it will be understood that the series of anode fingers 5 extends from side to side of each cell unit with an end finger $5^b$ at each end of the series of anode fingers 5, as illustrated in FIGS. 4 and 13, and that corresponding cathode fingers 6 extend between each anode finger 5, as illustrated on a larger scale in FIGS. 4 and 5.

The anode support bars $8^b$ provide a wall behind the hollow interior of the anode fingers 5, whereby a portion of the electrolyte which is carried upward in the interelectrodic gap $5^c$ and in the interior of the hollow anode fingers 5 by the rising anodic gas bubbles (chlorine) is recirculated downward in the spaces $5^k$ behind the wall of bars $8^b$ to the bottom of the anode compartments, thus providing up and down circulation from the front to the back of each anode compartment. The open spaces in the wall permit some equalizing flow of electrolyte between the back space $5^k$ and the front portion of the anode compartment but do not interfere with the up and down recirculation of the anolyte. The higher current density at which these cells operate produces a large volume of bubbles in the front portion of the anode compartment, which causes a vigorous upward flow of the electrolyte contained in this portion of the anode compartment and induces a downward movement of the electrolyte within the back space $5^k$. The volume of the gas release space inside the anode fingers and in the electrodic gap between the anodes and the diaphragm covered cathodes is more than twice the volume in the electrodic gap, so that in spite of the greater volume of gas bubbles, the flow of the electrolyte upward along the diaphragms is gentle so the new diaphragm can be deposited on the more porous portions of the diaphragms and old diaphragm material on the diaphragms is not disturbed.

In each cell unit, the base of each screen cathode finger 6 is welded to a cathode backing screen $6^b$ through a flared portion $6^d$, which is also welded to a plurality of short steel bars $6^e$ (see FIGS. 9 to 11). Round steel bars $6^f$ are welded, preferably friction welded, to the short steel bars $6^e$, a copper plug insert $7^a$ is preferably friction welded at the end of each steel bar $6^f$ and for the intermediate cell units a titanium stud $7^b$ is welded, preferably friction welded, to the copper plug insert $7^a$. The round steel bars $6^f$ are welded into holes provided in the intermediate separating partitions $3^f$ of the intermediate cell units (FIGS. 4 and 5) and the titanium lining $5^a$ on the anodic side of the intermediate separating partition $3^f$ is welded to the titanium studs $7^b$.

The cathode fingers 6 are then welded to the short steel bars $6^e$ and to the backing screen $6^b$ and the anode fingers 5 are welded or otherwise connected to the titanium studs $7^b$ by means of the assembly lugs 8 extending from the anode support bars $8^b$.

The titanium linings $5^a$ and the titanium studs $7^b$ provide a complete separation of the anode compartments from anodic steel end wall $3^a$ and from the steel walls $3^f$ of each of the intermediate separating partitions between the intermediate cell units. The lining $5^a$ and the studs $7^b$ provide a continuous, imperforate titanium wall between the anode compartments and the cathode compartments and prevent the anolyte and anodic gases from contacting the steel end walls $3^a$ and the intermediate steel walls $3^f$. The intermediate walls $3^f$ welded to the round steel bars $6^f$ provide a continuous imperforate steel wall between the cathode compartments and the back of the titanium linings $5^a$ and prevent any catholyte or catholyte products from contacting the titanium linings of the anode compartments. In the embodiments of FIGS. 1 to 11, the titanium linings $5^a$ are not welded to the steel back plates $3^a$ or $3^f$ and the current essentially flows, between the cell units, along the friction welded composite connectors $6^e$, $6^f$, $7^a$, and $7^b$.

At the terminal cathode end unit illustrated in FIG. 5, the steel bars $6^f$ extend into holes $3^e$ through the cathode end plate $3^c$ and are welded therein. Cathode back screen support bars $6^h$ extend between the intermediate steel separating plates $3^f$, the terminal cathode and plate $3^c$ and the cathode back screens $6^b$ in each cathode compartment, to support the cathode back screens and provide a space back of screens $6^b$ for free discharge of catholyte liquor and hydrogen to the rear of the cathodes. The copper plugs $7^a$ prevent hydrogen migration through the steel cathode structures into the titanium structures of the cell, which would form titanium hydride and eventually destroy the cell.

As described previously, the interior of each anode compartment is provided with a lining $5^a$ of titanium or other lining material resistant to anodic conditions. Side walls $5^b$ at each end of the anode waves 5, the interior of frames 2, and the anodes and all connections within the anode compartment are made of titanium or other valve metal, which extends over at least a portion of the flanges $2^a$.

The interior of the cathode compartments, the cathodes per se, the screen backing for the cathodes, etc., are preferably steel or other ferrous metal which is resistant to cathodic conditions.

For chlorine production, the diaphragms on the cathodes and cathode back screens separate each cell unit into an anodic compartment and a cathodic compartment and permit flow of electrolyte through the diaphragms, whereby hydrogen is released at the cathodes to produce hydrogen gas and the sodium ions which combine with the $OH^-$ ions to form sodium hydroxide and chlorine is released at the anodes.

The intermediate steel separating partitions $3^f$ and the titanium linings $5^a$ provide imperforate partitions between each of the intermediate cell units $1^b$, $1^c$, etc. The anode end element $1^k$ is likewise lined with titanium $5^a$, while the cathode end plate $3^c$ and the cathodic interior of the cathode end unit are steel or other ferrous metal.

Figure 1:
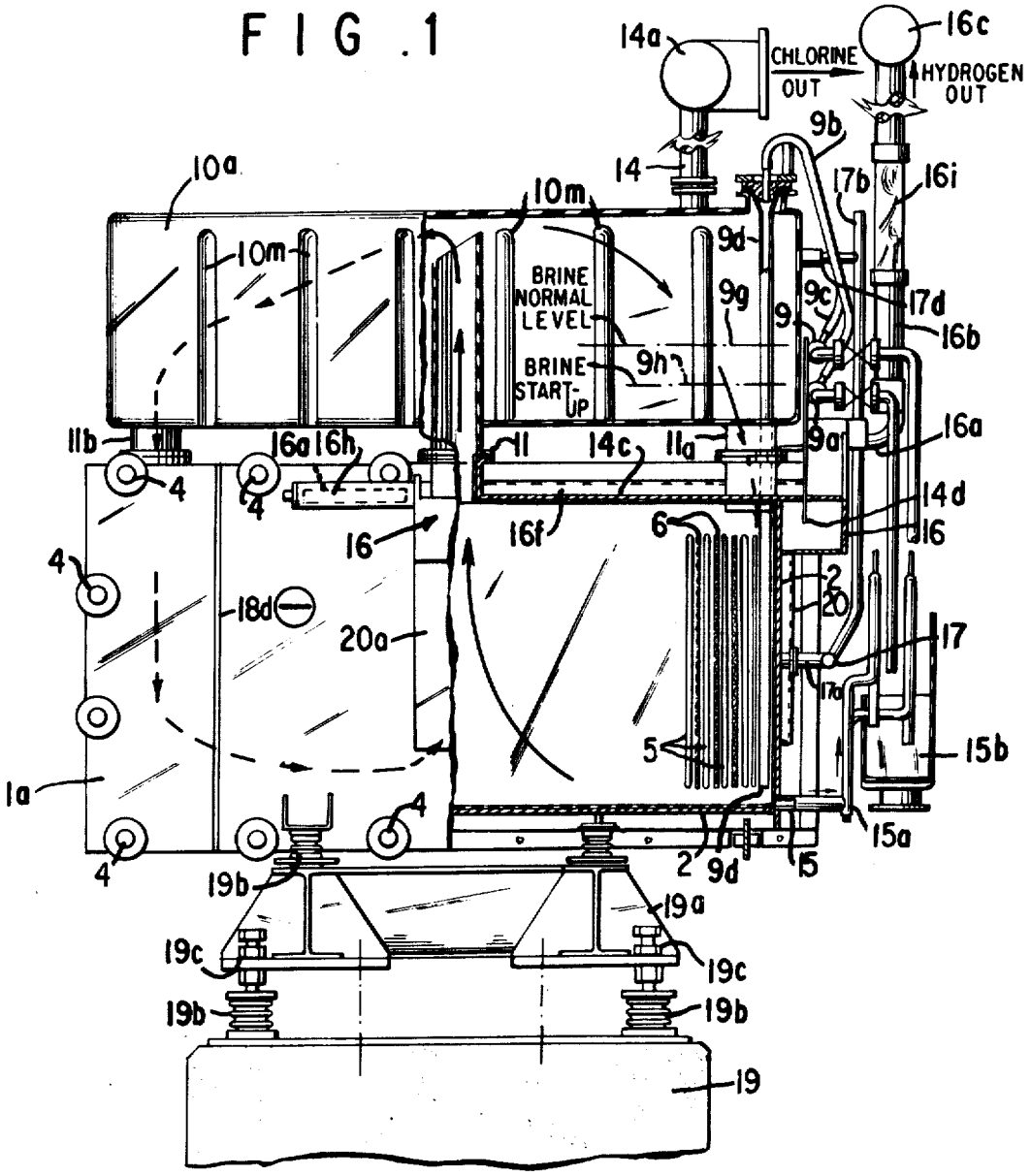
FIG. 1 is a front view, partially in sections, substantially along the line 1—1 of FIG. 3, of a bipolar cell.

Brine is introduced into each cell unit $1^a$, $1^b$, $1^c$, $1^i$, $1^k$, through brine headers 9 or $9^a$ connected to a brine supply source $9^f$ (FIG. 2). Header $9^a$ is used to fill and start operation of the cell with unsaturated brine, for purging the cells during shutdowns and as an auxiliary supply line in case of any failure or stoppage of the supply of saturated brine through the header line 9. Header 9 is used for normal operation with saturated brine. The use of unsaturated brine during the start-up prevents crystallization of salt in the cells, feed lines, etc. until the cells have reached their normal operating temperature. The brine level in the brine boxes during normal operation is shown by the line $9^g$ (FIG. 1), and the brine start-up level by the line $9^h$. From the headers $9^a$ or 9, the brine flows through brine feed hoses $9^b$ or $9^c$ into brine feed funnels $9^d$ in each of the fiber glass-reinforced polyester brine boxes $10^a$, $10^b$, $10^c$, $10^h$, $10^g$, and $10^k$ located above top of each of the cell units $1^a$, $1^b$, $1^c$, $1^i$, $1^j$, and $1^k$. The brine feed hoses are provided with shut-off clamps, etc. The brine feed funnels or dip tubes $9^d$ extend through the brine box approximately to the bottom of each of the cell units $1^a$, $1^b$, etc., as shown in FIG. 1, so that the fresh brine is delivered to or below the bottom of the anode fingers 5. The anode fingers 5 and cathode fingers 6 extend approximately from the top to the bottom of the anode and cathode compartments, but are spaced a short distance from the bottom and top of these compartments, as shown in FIGS. 1 and 2, to permit circulation and recirculation of the electrolyte within the cell units and permit escape of anodic and cathodic gases.

Each of the brine boxes $10^a$, $10^b$, $10^c$, etc., is connected with its corresponding cell unit $1^a$, $1^b$, $1^c$, etc., by brine box connections $11^a$ and $11^b$ at each end and a gas riser 11 at the center. The bottom of the gas riser 11 is flush with the top of each anode compartment and the top extends close to the normal operating brine level or just above it so that most of the chlorine (or other anodic gas) flows into the brine boxes through the center connection. The connections $11^a$ and $11^b$ extend a short distance below the top of the anode compartments and into the brine in the flooded anolyte compartment. Fresh brine flows downward through feed funnel $9^d$ and connections $11^a$, and recirculated brine flows downward through connections $11^a$ and $11^b$ into the anode compartments, so that, in operation, there is a constant recirculation of brine or anolyte downward at each end of the cell units $1^a$, $1^b$, $1^c$, etc., and upward, together with chlorine, through gas riser 11 in the center of each brine box $10^a$, $10^b$, etc., as indicated by the arrows in FIG. 1. Recirculation of the anolyte from the front to the back of each anode compartment of cell unit $1^a$, $1^b$, $1^c$, etc., is provided at the same time by the chlorine gas bubbles rising in the interelectrodic gaps $5^c$ between the anodes 5 and the diaphragm covered cathodes 6 and in the spaces $5^d$ inside the hollow anode fingers 5, which carry the anolyte upward to the top of the anode compartments where a portion of the anolyte separates from the gas bubbles and flows downward in the spaces $5^k$ behind the anode support bars $8^b$, as shown by the arrows in the sectioned cell $1^i$ in FIG. 2.

Most of the chlorine gas bubbles, upon reaching the top of the anode compartment, escape through the gas riser 11 imparting an upward thrust to the electrolyte present inside the gas riser 11. The electrolyte rises with the gas to the top of the riser 11 and overflows into the electrolyte pool in the brine boxes $10^a$, $10^b$, etc., whereby the chlorine gas separates from the brine. Simultaneously, an equivalent volume of electrolyte moves down through the connections $11^a$ and $11^b$ and enters the anode compartment near the side walls of the compartment.

The dotted circle $11^a$ in FIG. 5 shows the approximate location of the downcoming connection $11^a$ with reference to the anode compartment width.

In this way, a circulation motion of the electrolyte to and from the anode compartment and the cooperating brine box is created. This motion, in cooperation with the recirculation motion of the anolyte within each anode compartment resulting from the division of the anode compartment by the separating wall formed by anode support bars $8^b$ into a front portion, affected by the upward flow of the gas and of the anolyte, and rear portion $5^k$ (FIG. 4) wherein anolyte brought to the top of the anode compartment is recirculated to the bottom of the compartment, produces an intense recirculation of the anolyte from near the side walls towards the center of the anode compartment and through the brine box riser 11 and downcomers $11^a$ and $11^b$ and from the front to the back or from the top to the bottom of the anode compartment.

The advantages of such a recirculation are many; the composition and temperature of the anolyte are maintained substantially uniform through the cell, the two recirculation motions facilitate rapid evacuation of the gas bubbles from the interelectrodic gap and their disengagement from the electrolyte and allow the full exploitation of the upward thrust imparted by the rising gas bubbles to the electrolyte; the fresh brine, fed into the cell through the feed funnels $9^d$, to make up for the electrolyte which percolates through the diaphragm into the cathode compartments during the operation of the cell, is immediately drawn into circulation. In this way, the cell can tolerate high current densities with very high current efficiencies.

The intense recirculation motion of the anolyte allows new diaphragm material, such as asbestos fibers or powders introduced into the recirculating brine, to be kept in suspension. As described above, the diaphragms are never perfect and the diaphragms deposited originally over the cathode screens are subject to wear and deterioration. In diaphragm cells of the prior art, it was necessary to completely renew the asbestos diaphragm every three to seven months of operation. In the cell of the present invention, it is possible to introduce a certain amount of asbestos, either in fiber or in powder form, in the anolyte periodically or when needed. The asbestos fibers so introduced are maintained in suspension in the anolyte and are slowly deposited onto the diaphragms, especially at places where the porosity is greater. In this way, limited worn and porous areas of the diaphragm, holes, etc., become covered with an additional layer of asbestos which prevents the erosion of the diaphragms from proceeding unhindered to an irreversible rupture of the diaphragm and maintains optimum diaphragm porosity and integrity during normal cell operation.

Stoppered diaphragm feed inlets 13 are provided at the brine feed end of each brine box $10^a$, $10^b$, $10^c$, etc., through which new diaphragm material may be introduced into the cell units as the diaphragms are eroded or deteriorate in service. The diaphragm material is introduced as a slurry or as moist solid sticks through inlets 13, and is carried downwward by the recirculating brine through connection $11^a$ to below the bottom of the diaphragm covered cathodes and recirculated upwardly along the cathode fingers 6 and cathode screens $6^b$, where it deposits on any portion of the diaphragm where more diaphragm material is needed to repair the more porous areas which have developed in the diaphragms.

From the brine boxes $10^a$, $10^b$, $10^c$, etc., the chlorine, separated from the brine, flows through chlorine outlets 14 from each brine box into a chlorine header $14^a$ leading to a chlorine manifold outlet $14^b$ which is connected to a chlorine recovery or disposal system.

Figure 3:
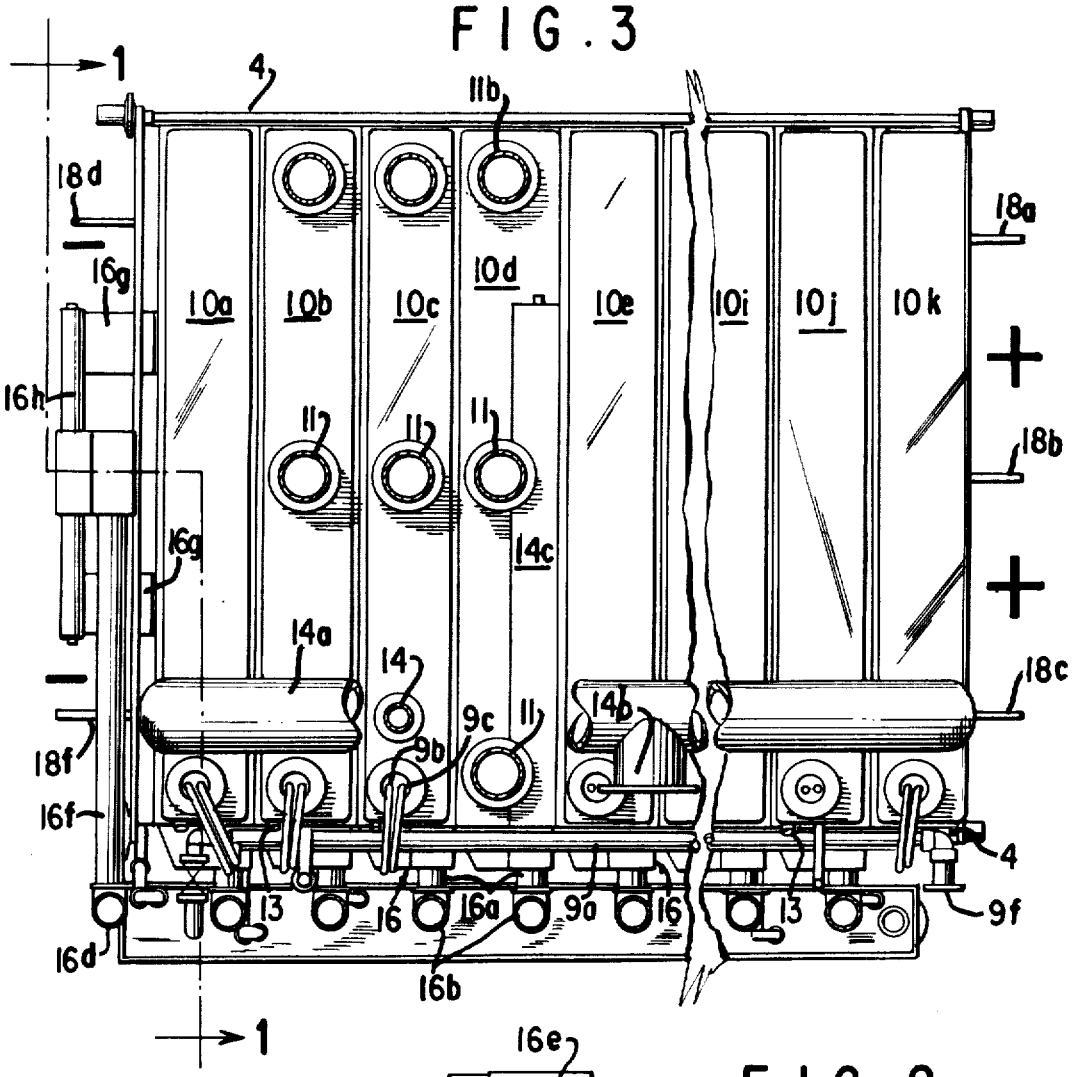
FIG. 3 is a plan view of the bipolar cell illustrated in FIGS. 1 and 2, with portions of the cell omitted.

As the depleted brine flows through the diaphragms on cathodes 6 and cathode backing screens $6^b$, hydrogen is released at the cathodes and the sodium ions combine with the $OH^-$ ions to produce sodium hydroxide. The sodium hydroxide flows out of each cell unit $1^a$, $1^b$, $1^c$, etc., through the caustic outlet 15 adjacent the bottom of each cathode chamber in the cell units and into pivotted, inverted U-shaped caustic liquor discharge or perc pipes $15^a$, which discharge the caustic into a cell liquor through $15^b$, from which it flows to a caustic recovery or disposal system. The position to which the inverted U-shaped, pivotted pipes $15^a$ are turned determines the catholyte level in each of the cell units $1^a$, $1^b$, $1^c$, etc., and controls the flow of anolyte through the diaphragms which depends on the hydrostatic pressure difference across the diaphragms. Hydrogen released in the cathode compartment of each of the bipolar units and separated from the catholyte liquor flows through a hydrogen channel $14^c$ along the top of each cathode compartment to the end of the cell units $1^b$, $1^c$, etc., where it flows under baffles $14^d$ and through openings (not shown) into a hydrogen discharge box 16 (FIG. 1) and through an opening in the top of box 16 into a hydrogen outlet pipe $16^a$ and pipes $16^b$ to a hydrogen manifold $16^c$ and then to a recovery system. The hydrogen outlet for the intermediate elements is at the end of each cell unit. Each of the hydrogen outlet pipes $16^b$ is provided with a pyrex glass section $16^i$ which permits inspection of the hydrogen flow and insulates the hydrogen discharge system from the cell currents. The hydrogen outlet for the terminal cathode end element is on the side of the cathode end element and is indicated at $16^d$ (FIG. 3). The hydrogen from the terminal cathode chamber in cell unit $1^a$ flows from the center of the cell unit through outlets $16^g$ in the cathode end element into hydrogen gatherer $16^h$, which connects with extension pipe $16^f$ extending between the center of cathode end plate $3^c$ and the hydrogen outlet pipe $16^d$ for the terminal cathode unit.

A catholyte liquid return channel 20 (FIGS. 1 and 5*a*) extends from the hydrogen discharge box 16 at the top of each cell unit to the lower part of each catholyte chamber, to return any catholyte liquor in the hydrogen discharge stream to the cathode compartments. In the cathode end element a catholyte liquor return channel $20^a$ at the center of this element also returns catholyte liquor to the cathode compartment in the cathode end element.

Figure 5A:
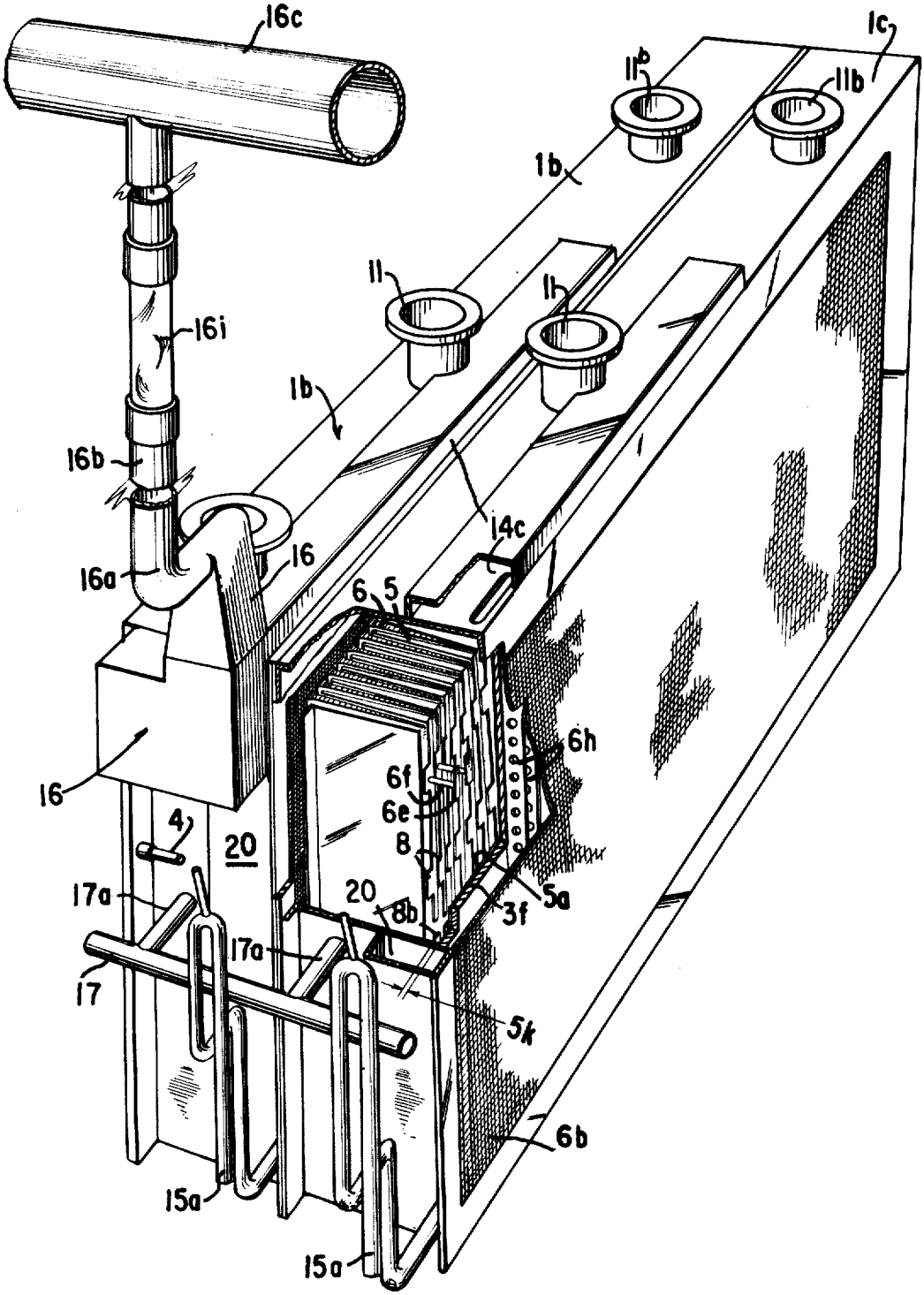

FIG. 5*a* shows a portion of two intermediate cell units in which unit $1^b$ is a substantially complete unit and unit $1^c$ is partially broken away to show the interior construction. Unit $1^c$ shows only the diaphragm covered cathodes 6 with the back screen $6^b$ and supports $6^h$ spacing the back screen $6^b$ from the steel portion of an intermediate separating and supporting plate $3^f$. Unit $1^c$ shows the nested titanium anode fingers 5 and cathode fingers 6. The hydrogen channel $14^c$ discharges hydrogen into the hydrogen discharge box 16 from which it flows into the $H_2$ outlet pipe $16^a$, equipped with a pyrex glass section $16^i$, and the catholyte liquor flows into the catholyte liquid return channel 20.

Each of the anode compartments is connected to an equalizing header pipe 17 extending along the entire cell, by means of outlet pipes $17^a$ (FIGS. 1, 4 and 7) from each cell unit. Each outlet pipe $17^a$ has an insulating connection pipe $17^e$ (FIG. 7) which projects through the element nozzle $17^f$ into the anolyte compartment to protect the titanium lining $5^a$ of the anolyte compartment from electrolytic corrosion. Near each end of the header pipe 17, brine level indicator pipes $17^b$, provided with transparent upper portions $17^c$ of pyrex glass or other suitable material, extend upward and are connected into the brine boxes $10^b$ and $10^j$ by connectors $17^d$. The brine header 17 connected with each cell unit $1^a$, $1^b$, $1^c$, etc., assures that the proper brine level will be maintained in each cell unit.

Positive terminal connectors $18^a$, $18^b$, and $18^c$ are provided at the anodic end of the cell for connection with a suitable DC current, and negative terminal connectors $18^d$, $18^e$, and $18^f$ are provided at the cathodic end of the cell.

FIG. 13 shows a plan view of the anode fingers 5 and the titanium anode end fingers $5^b$ as they are provided in each cell unit and FIG. $13^a$ is an enlarged area showing the separating wall formed by the anode support bars $8^b$ and assembly lugs 8 and the gaps $8^a$.

FIGS. 14 and 14*a* illustrate the expanded sheet metal reticulated type anodes 5 made of titanium, tantalum or other valve metal, provided with an electrically conducting electrocatalytic coating (not shown in the drawings) on at least one face of the anode. The coated face of each anode is preferably opposite a diaphragm covered cathode face 6, with the interelectrodic gap therebetween. These anodes have diamond-shaped openings $5^e$, in which the bottom central portion $5^g$ of each diamond is rearward of the vertical center plane of the anode and the top central portion $5^h$ of each diamond is forward of the vertical center plane of the anode face. The corners of each diamond-shaped opening lie approximately in the vertical plane of the anode. The lower half $5^g$ of each diamond-shaped opening is tilted or pushed toward the cathode C (FIG. 14*a*), while the upper half $5^h$ of each diamond-shaped opening is tilted or pushed away from the cathode C, so that gases released on the lower half of and below each diamond-shaped opening pass through said opening to the back or rear of the anode (away from the cathode) and are deflected rearwardly of the anode by the forwardly tilted upper half of the diamond-shaped opening and into the electrolyte space at the rear or inside the hollow fingers 5 of the anode, as indicated by the arrows $5^i$ in FIGS. 14*a* and 15. In FIG. 14, the solid portions of the arrows $5^i$ indicate the path of the gases along the lower leg of each diamond-shaped opening and the dotted portion of the arrows indicate the path of the gases behind the upper portion of each diamond-shaped opening and away from the cathode. By this construction most of the gas released along the legs which are tilted to the rear of the anode, when released into the diamond-shaped opening, is deflected to the rear of the anode by the legs which are tilted toward the front of the anode. In this way, most of the gases released along the coated face of the anodes are directed through the opening in the anodes and deflected to the interior $5^d$ of the anode fingers 5, away from the interelectrodic gap between the anode faces and the cathodes and their diaphragms, so that the gas and electrolyte flow along the diaphragms is gentle and the diaphragm material is not disturbed while new diaphragm material added through openings 13 is deposited on the more porous areas of the diaphragms.

While diamond-shaped openings $5^e$ have been illustrated in FIGS. 14, 14*a* and 15, it will be understood that square, round, triangular, hexagonal or other shaped openings may be provided in anode faces, with the lower portion of each opening tilted toward the side of the anode facing the cathode and the upper portion of each opening tilted or pushed toward the side of the anode facing the interior $5^d$ of the anode fingers, to accomplish the same object, namely, to pass the gases released at the front of each anode through the opening therein and deflect them to the rear of each anode and into the interior of the hollow anode fingers which provide a larger area for the escape of the anodic gases than the interelectrodic gap per se.

Instead of reticulated metal, the walls of the anodes may be formed of spaced titanium rods $5^j$, vertically mounted on suitable supports $5^k$, attached to anode support bars $8^b$, as illustrated in FIG. 16, in which the anodic gases formed in the interelectrodic gap readily pass between the rods and into the hollow interior of the anode fingers.

FIGS. 17 and 18 illustrate a modified construction, in which the anode fingers 5 are mounted on support bars $8^b$ having gaps $8^a$ between each support bar, and the anode assembly lugs 8. The anode assembly lugs 8 are connected by welding, or otherwise, to titanium studs $7^b$ welded to an imperforate titanium liner $5^a$, which is on the anodic side of the positive end steel support plate $3^a$ and of the intermediate steel supporting plates $3^f$. In this embodiment, the titanium lining $5^a$ is welded to the steel plates $3^a$ and $3^f$ so that current flows through the end plates $3^a$–$5^a$ and the intermediate separating partitions $3^f$–$5^a$ from the anodes to the cathode end of the cell. The screen cathodes 6 in FIGS. 17 and 18 are mounted between the anodes 5, as described in connection with FIGS. 4 and 5, on angular steel supports $6^h$, which project from the cathode end plate $3^c$ and the intermediate steel partitions $3^f$, so that the anode end plate $3^a$, the cathode end plate $3^c$ and the intermediate partitions $3^f$ do not have holes therethrough. For chlorine production, the cathodes 5 are provided with diaphragms as described previously. The other portions of FIGS. 17 and 18 are similar to like parts in FIGS. 4 and 5.

In both the main embodiments of FIGS. 1 to 16 and the modified embodiment of FIGS. 17 and 18, the titanium linings $5^a$ and titanium studs $7^b$ form an imperforate valve metal lining for the anode compartments, and the valve metal support studs $7^b$ projecting from the lining $5^a$ support the anode fingers mounted on anode support bars $8^b$, so that the bases of the hollow anode fingers are spaced from the lining $5^a$ of the anode compartments to provide a downward recirculating space $5^k$ for the electrolyte behind the support bars $8^b$.

The cell is mounted on a suitable insulated base 19, supporting channel members $19^a$insulators $19^b$ and adjustable levelling bolts $19^c$. Teflon sliding plates (not shown) on channel members $19^a$ permit sliding the element along the support for assembly and disassembly.

The fiber glass-reinforced polyester brine boxes $10^a$, $10^b$, $10^c$, etc. have strengthening indentations $10^m$ (FIG. 1) formed in their side walls, which, however, do not prevent flow of brine from end to end of the brine boxes. The space above the brine normal level indicated in FIG. 1 is occupied by chlorine and whatever foam is formed, and the flow of brine from the center chlorine outlet 11 to the down connections $11^a$ or $11^b$ tends to break the foam and release chlorine bubbles trapped therein.

In the all-metal electrolytic cells described above, the anolyte liquor is substantially free of resinous organic compounds, released by the gradual erosion and deterioration of carbonaceous anodes, and cementitious compounds of alkaline earth metals, solubilized by the electrolyte from concrete cell components of prior art cells. During electrolysis, a hydrostatic head is maintained on the anolyte liquor while electrical current is passed from the anode through the diaphragm to the cathode. The hydrostatic head helps to limit the formation of chlorate ion in the anolyte liquor. In the all-metal cells described above, the hydrostatic head may be constant with time, or it may decrease with time, as the anolyte liquor is substantially free of diaphragm head increasing impurities. The cell and method of this invention limits the rate of chlorate formation over extended periods of electrolysis by the further step of addition of asbestos to the anolyte chamber of the cells at a rate of asbestos addition responsive to the chlorate ion content of the anolyte liquor. The rate of asbestos addition is high enough to maintain a gel layer on the anode facing side of the diaphragm and to maintain a low chlorate content in the anolyte liquor, but low enough to maintain a low hydrostatic head between the anolyte chamber and the catholyte chamber.

It is believed that the electrochemical behavior of the diaphragm is due to the formation of a "gel layer". This "gel layer" is described by Kircher, "Electrolysis of Brines in Diaphragm Cells," in Sconce, ed., Chlorine, A.C.S. Monograph Series, No. 154, Reinhold Publishing Co., New York (1962), at page 105, as a layer "formed within the asbestos mat which is sensitive to pH and which tends to dissolve, precipitate and reform depending upon flow rate and salt content and pH of the flowing liquor."A "gel layer" of at least about 0.08 to about 0.12 inch should be present on the anolyte surface of the diaphragm in order to obtain satisfactory electrolytic performance. Where the "gel layer" is less than about 0.08 inch thick, for example, because the total asbestos diaphragm thickness is less than 0.08 inch, or because the diaphragm has been thermally or chemically stabilized, e.g., by resin impregnation, unsatisfactory electrolytic performance may occur. Unsatisfactory electrolytic performance, e.g., low anode current efficiency, oxygen in the chlorine gas, and the like, may be further evidenced by a high chlorate content in the anolyte liquor.

The mechanism of chlorate formation and its relationship to diaphragm performance may be understood by considering the electrode reactions and electrolyte equilibria. The following reaction occurs at the anode:

$$2Cl^- \rightarrow Cl_2 + 2e^- \quad (1)$$

while the reaction at the cathode is:

$$2H_2O + 2e^- \rightarrow 2H_2 + 2OH^-. \quad (2)$$

The equilibria in equations (3), (4) and (5);

$$Cl_2 + OH^- \rightleftharpoons Cl^- + HOCl, \quad (3)$$

$$HOCl \rightleftharpoons H^+ + OCl^-, \text{ and} \quad (4)$$

$$2HOCl + OCl^- \rightleftharpoons ClO_3^- + 2Cl + 2H^+, \quad (5)$$

are postulated to occur in the anolyte liquor. The overall product of these reactions is chlorate ion, $ClO_3^-$. The concentration of chlorate ion in the anolyte liquor is correlated with loss of anode current efficiency. The formation of hypochlorous acid, HOCl, is favored by a high pH in the anolyte liquor, as is the decomposition of a hypochlorous acid, HOCl, into hydrogen ion and hypochlorite ion, $OCl^-$. The hypochlorous acid and hypochlorite ion then combine to yield chlorate ion, $ClO_3^-$, as shown in equation (5). This reaction is also favored by a high pH. Thus, as is well known in the art, a high pH favors the formation of chlorate ion in the anolyte liquor, thereby resulting in a significant loss of anode current efficiency.

Similarly, a high pH is analogous to a low pOH, or high hydroxyl ion concentration in the anolyte. This results in oxygen evolution, as shown in equation (6), thereby further reducing the anode current efficiency:

$$4OH^- \rightarrow O_2 + 2H_2O + 4e^-. \quad (6)$$

Maintenance of the gel thickness to control the pH of the anolyte liquor and suppress hydroxyl ion diffusion from the catholyte liquor through the diaphragm into the anolyte liquor, thereby controlling chlorate formation, is of extreme importance in the operation of a diaphragm cell.

Anolyte liquor chlorate ion content is controlled by maintaining the percent decomposition of the brine below 100 percent; for example, by maintaining a positive hydrostatic head of anolyte liquor while feeding brine to the cell at a feed rate in excess of the passage of electrical current through the cell, so that from about 75 percent to about 25 percent of the sodium chloride is recovered with sodium hydroxide from the catholyte liquor rather than electrolyzed. Generally, the percent decomposition is from about 40 percent to about 60 percent, to provide a proper balance of evaporation costs and current efficiency. Percentage decompositions greater than about 60 weight percent result in decreased current efficiency, while percent decompositions less than about 40 percent have no positive effect on the current efficiency and merely increase the crystalizer/evaporator work load.

A low percent decomposition, e.g., less than about 60 percent decomposition, retards formation of the chlorate ion in the anolyte liquor. It is believed that a high percent decomposition favors the back migration of hydroxyl ion and a low percent decomposition discourages the back migration of hydroxyl ion from the catholyte chamber to the anolyte chamber. While not wishing to be bound by this explanation, it is generally believed that the back migration of hydroxyl ion raises the anolyte liquor pH, thereby encouraging the formation of chlorate ion as described above. Additionally, high current efficiency is correlated with a low anolyte liquor chlorate content, the presence of chlorate liquor representing a loss of evolved chlorine. However, over extended periods of electrolysis, the current efficiency declines, the anolyte liquor chlorate content increases, necessitating a decrease in the percent decomposition.

Regular addition of asbestos to the cell to maintain the gel layer, e.g., responsive to the anolyte liquor chlorate content, allows the current efficiency to be maintained within about 0.9 to about 1 percent of a base value over extended periods of electrolysis. By a base value of current efficiency is meant the current efficiency which has been attained after the attainment of steady state operation and prior to a decrease of current efficiency with increasing hydroxyl migration through the diaphragm. This is generally the time period of from about 4 to about 6 weeks after a diaphragm has been installed in the electrolytic cell and electrolysis has been commenced. By an extended period of electrolysis is meant a period of from about 18 to about 24 months or more. The regular addition of asbestos to the anolyte liquor of the cell maintains the chlorate content of the anolyte liquor within about 0.1 weight percent, anhydrous basis, of a base state, and frequently within about 0.05 weight percent, anhydrous basis, of the base state, and occasionally even within about 0.04 weight percent, anhydrous basis, of the base state over extended periods of electrolysis and the regular addition of asbestos to the anolyte liquor of the cell can maintain the concentration of hydrogen in the chlorine gas product within about 0.05 volume percent of the base state, e.g., within about 0.05 to about 0.1 volume percent, total hydrogen in the chlorine gas.

The regular addition of small amounts of asbestos to the anolyte liquor may continue for periods of 18 or 24 or more months. After 18 to 24 months of asbestos addition, the hydrostatic head across the diaphragm is generally less than 50 inches of brine above its initial value and is usually within about 5 to 10 inches of brine above its initial value.

By a regular addition of asbestos is meant the addition of asbestos at a known rate, by continuous addition of asbestos, by semicontinuous addition of asbestos, by addition of asbestos at intervals, or by addition of asbestos in response to cell parameters.

The method of this invention includes operating an electrolytic cell over extended periods of electrolysis while adding small amounts of asbestos to the anolyte liquor and constantly circulating the anolyte liquor past the diaphragms, and more particularly, maintaining a cell that has been operating satisfactorily, in continued satisfactory operating conditions over a long period of time. This is accomplished by monitoring the anolyte liquor chlorate ion content, the chlorine gas hydrogen content, and regularly adding asbestos to the anolyte liquor either in substantial response thereto or at a rate of addition sufficient to maintain the chlorate ion content and the hydrogen gas content substantially constant.

The rate of addition of asbestos to the anolyte liquor is high enough to maintain a low chlorate ion content in the anolyte liquor, but low enough to maintain a low hydrostatic head across the diaphragm. For example, the asbestos addition should be maintained at a high enough rate to maintain the anolyte chlorate content at less than about 0.2 weight percent, anhydrous basis, of the anolyte liquor, and preferably less than about 0.15 weight percent, anhydrous basis, of the anolyte liquor. Where an anode system is used having a high oxygen overvoltage and a low chlorine overvoltage, such as a ruthenium dioxide-titanium dioxide coated titanium anode, described for example in said U.S. Pat. Nos. 3,632,498 and 3,711,385, the chlorate content of the anolyte liquor is less than about 0.1 weight percent, anhydrous basis, and the rate of asbestos addition is high enough to maintain the chlorate ion content of the anolyte liquor below about 0.15 weight percent, anhydrous basis, in excess of 85 percent of the on line time. The chlorate ion content of the anolyte liquor may be determined by methods well known in the art, such as withdrawal and analysis of a sample of the anolyte liquor.

The asbestos addition may be continued for at least 18 to 32 months or more. Generally, the rate of addition is greater than about 0.0005 pounds of asbestos per square foot of diaphragm area per week and less than about 0.100 pounds of asbestos per square foot of diaphragm area per week. Preferably, the rate of asbestos addition is from about 0.001 to about 0.005 pounds of asbestos per square foot of diaphragm area per week. Rates lower than about 0.0005 pounds per square foot per week provide minimal control of anolyte liquor chlorate content, while rates greater than about 0.10 pounds per square foot per week over many months may appreciably increase the head across the diaphragm without providing any additional control of the anolyte liquor chlorate content. In this way, a gel layer is maintained that is at least about 0.08 inch thick and that may be as thick as 0.12 inch. Occasional additions of asbestos in excess of 0.10 pounds per square foot per week may, however, be resorted to, to plug holes in the diaphragm.

The basis for the rate of asbestos addition is determined from the time of the commencement of asbestos addition and not from the time of the commencement of electrolysis, unless the commencement of asbestos addition is contemporaneous with the start up of the cell.

Asbestos addition may be commenced contemporaneously with the start up of the cell. Preferably, however, asbestos addition is commenced subsequent to the start up of the cell, for example, as early as 60 days after start up of a cell to as late as 240 days after start up of a cell. Asbestos addition is commenced when certain operating conditions are observed, such as when there is an increase of hydrogen volume in the cell gas in excess of about 0.02 weight percent per week, either in one week or cumulatively, or when there is a decrease of current efficiency of about 1 percent per week, either in one week or cumulatively. However, this represents an upper limit of time when asbestos addition should be commenced, and asbestos addition may be commenced when the current efficiency drops by as little as 0.1 percent per week, either in one week or cumulatively. Current efficiency decreases of about 0.1 percent per week may be evidence of chlorate formation and increased rates of chlorate formation in the anolyte liquor.

Asbestos addition may also be commenced when the chlorate content of the anolyte liquor is increasing with time. Increasing anolyte chlorate content is evidenced by diminished current efficiency and a higher pH. Preferably, asbestos addition is commenced when the chlorate content of the anolyte liquor increases by an amount of 0.02 percent per week, anhydrous basis, either in one week or cumulatively, and is definitely commenced when the chlorate content of the anolyte liquor increases by about 0.15 weight percent per week, either in one week or cumulatively.

The asbestos addition is most commonly in the form of 4-T asbestos having a Quebec screen test minimum as shown in Table I;

TABLE I

| Grade | Asbestos Quebec Screen Test 2M | 4M | 10M | Pan |
|---|---|---|---|---|
| | (M = screen mesh) | | | |
| 4-T | 0 | 2 | 10 | 4 |

Finer grades of asbestos, such as Grade 5, or coarser grades of asbestos, such as Grade 3 (for example, Grades 3-T or 3-Z or 5) may be utilized.

In a preferred exemplification of this invention, the asbestos is shaped into "rolls" by slightly wetting 4-T short fiber asbestos with water and then passing the wetted fibers through a compactor to form rolls about 6 inches long and about 1 to 1½ inches in diameter. Typically, each roll contains from about 1½ to about 3 ounces of asbestos, on a dry basis. These rolls are then added to the cells through the diaphragm material feed inlets 13 or by other means. The rolls are carried nearly all the way to the bottom of the cell by the recirculating brine before breaking apart and the asbestos or other diaphragm material is then carried by natural brine circulation to all parts of the diaphragms.

Alternatively, the asbestos addition may be by adding asbestos powder, for example Grade 5 asbestos powder, directly to the brine feed or even directly to the cell itself.

According to still another exemplification of this invention, a one to two weight percent of short fiber asbestos, e.g., 4-T asbestos, in sodium chloride brine may be prepared and added to the anolyte liquor, e.g., through the brine feed tubes $9^b$, $9^c$, or $9^d$.

The asbestos diaphragms are prepared by methods well known in the prior art. In one method, a solution of cell liquor containing about 15 to 25 weight percent sodium chloride and about 10 to 15 percent sodium hydroxide is prepared. To this solution is added sufficient asbestos, e.g., Grade 3 or Grade 4, or preferably a mixture of Grades 3 and 4, to provide a slurry containing about 0.5 to about 1.5 weight percent asbestos. Thereafter, a cathode section, e.g., screens 6, $6^b$, etc., is immersed in the slurry and a vacuum is drawn within the cathode chamber to draw the asbestos on to the cathode screens. However, this invention is equally applicable to diaphragms drawn from sodium hydroxide solutions, water or organic solvents and to membrane diaphragms. Additionally, the method of this invention is useful where the diaphragm contains additives, impregnants, coatings, additional layers of asbestos on the surface thereof, or layers or impregnants of polymers such as thermoplastics, thermoset resins, halocarbon resins, fluorocarbon resins, ion exchange resins, and the like. This invention is, however, particularly applicable to diaphragms characterized by the substantial absence of solvents, aromatic solvents, oils, organic acids, chlorinated organic acids, linseed oil, and other physical degradation/chemical degradation products of graphite anodes building up in the asbestos over time. The method of this invention contemplates a substantial absence of alkali metal compounds, such as calcium hydroxide-calcium carbonate, calcium sulfate, magnesium hydroxide, magnesium carbonate and magnesium sulfate, as evolved by the concrete cell body of the prior art during the decomposition thereof, over the life of the cell body, and a deposition of decomposition products in the asbestos diaphragm.

The hydrostatic heads on the diaphragms are from about 6 inches to about 50 inches, and preferably from about 12 inches to about 24 inches of brine.

The following example is illustrative of the method of this invention.

EXAMPLE

An eleven-cell bipolar electrolyzer, $1^a$, $1^b$, $1^c$ to $1^k$, having titanium clad steel anolyte chambers and ruthenium dioxide-titanium dioxide coated titanium anodes interleaved between steel cathodes was operated for a period of 974 days with the periodic addition of asbestos. The cell, of course, may be so operated for much longer periods of time.

The diaphragms were 3T/4T asbestos diaphragms, deposited on the steel cathode fingers 6, backing screens, etc., and ranged in weight from 0.35 pounds of asbestos per square foot to 0.42 pounds of asbestos per square foot.

The diaphragms were prepared by preparing a 1.5 to 1.8 weight percent slurry of one part 3T-12 asbestos and two parts 4T-12 asbestos in a cell liquor solution containing 11 weight percent sodium hydroxide and 19 weight percent sodium chloride. The asbestos content was maintained at 1.5 to 1.8 weight percent (dry basis) by the periodic addition of asbestos to the slurry.

The diaphragms were deposited by immersing the cathode section of each bipolar unit in the asbestos slurry and drawing the slurry through the screen cathodes.

After assembly of the cell units, as described with reference to FIGS. 1, 2, 3, etc., operation of the eleven-unit cell was commenced, and continued, in this example, for 29 days without the addition of diaphragm material.

Asbestos addition in one cell of the electrolyzer was commenced at the 29th day and asbestos was added at later times in each cell. The cell operating parameters are shown in Table II. The first addition was made to Cell No. 10.

The number of additions of asbestos varied from 23 to 61 additions and the pounds per square foot per addition varied from 0.0047 to 0.0067 pounds per square foot and from 0.001 to 0.008 pounds per square foot per week. The total pounds per square foot of asbestos added are shown in Table II, as are pounds per square foot per week where the time was calculated from the first addition of asbestos to the last day of operation of the electrolyzer in this test operation. As shown by FIG. 19, the sodium chlorate content of the anolyte liquor varied from 0.03 to 0.19 weight percent, anhydrous basis, during the first 966 days of operation except as noted below but never attained a higher value than about 0.19 weight percent, anhydrous basis, during the first 966 days of operation except as noted below. When the sodium chlorate content of the anolyte liquor of a particular cell exceeded 0.2 weight percent, anhydrous basis, of the anolyte liquor of said cell, and preferably when it exceeded 0.15 weight percent of the anolyte liquor of said cell, asbestos addition to said cell was begun and continued until the chlorate content of the anolyte liquor in said cell was brought within the desired limit, and periodic additions were made thereafter as needed.

TABLE II

Asbestos Addition to Individual Cells of an Eleven Cell Bipolar Electrolyzer

| Cell No. | 1 | 2 | 3 | 4 | 5 |
|---|---|---|---|---|---|
| Initial Diaphragm Lbs./ft.$^2$ | .36 | .40 | .35 | .40 | .39 |
| Days to First Addition | 175 | 140 | 107 | 96 | 120 |
| No. of Additions | 23 | 46 | 47 | 57 | 57 |
| Cumulative Lbs./ft.$^2$ Added By End of Period: | | | | | |
| Days | | | | | |
| 30 | 0 | 0 | 0 | 0 | 0 |
| 60 | 0 | 0 | 0 | 0 | 0 |
| 90 | 0 | 0 | 0 | 0 | 0 |
| 120 | 0 | 0 | .0326 | .0209 | .00465 |
| 150 | 0 | .0139 | .0558 | .0302 | .0139 |
| 180 | .00465 | .0139 | .0558 | .0488 | .0139 |
| 210 | .00465 | .0395 | .0558 | .06511 | .0256 |
| 240 | .01163 | .0465 | .0628 | .0698 | .0256 |
| 270 | .01630 | .0651 | .0744 | .0884 | .0372 |
| 300 | .0267 | .0791 | .0802 | .1023 | .0418 |

TABLE II-continued

Asbestos Addition to Individual Cells of an Eleven Cell Bipolar Electrolyzer

| | | | | | | |
|---|---|---|---|---|---|---|
| 330 | .0372 | .0942 | .0907 | .1221 | .0569 | |
| 360 | .0419 | .0988 | .0953 | .1337 | .0686 | |
| 390 | .0419 | .1069 | .1000 | .1477 | .0733 | |
| 420 | .0512 | .1163 | .1093 | .1616 | .0826 | |
| 450 | .0558 | .1209 | .1151 | .1709 | .0872 | |
| 480 | .0605 | .1256 | .1198 | .1849 | .1012 | |
| 510 | .0626 | .1276 | .1218 | .1914 | .1056 | |
| 540 | .0641 | .1346 | .1241 | .1937 | .1102 | |
| 570 | .0661 | .1381 | .1323 | .1972 | .1137 | |
| Cell No. | 1 | 2 | 3 | 4 | 5 | |
| Days | | | | | | |
| 600 | .0708 | .1427 | .1404 | .1995 | .1346 | |
| 630 | .0754 | .1462 | .1439 | .2030 | .1392 | |
| 660 | .0834 | .1548 | .1524 | .2116 | .1478 | |
| 690 | .0834 | .1548 | .1524 | .2116 | .1478 | |
| 720 | .0834 | .1594 | .1571 | .2162 | .1548 | |
| 750 | .0927 | .1710 | .1664 | .2209 | .1617 | |
| 780 | .0950 | .1710 | .1687 | .2278 | .1617 | |
| 810 | .0973 | .1756 | .1756 | .2348 | .1664 | |
| 840 | .0997 | .1756 | .1756 | .2348 | .1664 | |
| 870 | .1031 | .1838 | .1814 | .2418 | .1722 | |
| 900 | .1124 | .1930 | .1884 | .2510 | .1814 | |
| 930 | .1124 | .1930 | .1884 | .2510 | .1814 | |
| 960 | .1171 | .2000 | .1942 | .2580 | .1861 | |
| Total Lbs./ft.$^2$ | .1217 | .2000 | .1942 | .2580 | .1907 | |
| Lbs./ft.$^2$-week | .00087 | .00144 | .00140 | .00185 | .00137 | |
| Cell No. | 6 | 7 | 8 | 9 | 10 | 11 |
| Initial Diaphragm Lbs./Ft.$^2$ | .39 | .37 | .42 | .35 | .38 | .35 |
| Days to First Addition | 198 | 108 | 190 | 238 | 29 | 108 |
| No. of Additions | 34 | 61 | 42 | 28 | 54 | 36 |
| Cumulative Lbs./ft.$^2$ Added By End of Period: | | | | | | |
| Days | | | | | | |
| 30 | 0 | 0 | 0 | 0 | .0372 | 0 |
| 60 | 0 | 0 | 0 | 0 | .0488 | 0 |
| 90 | 0 | 0 | 0 | 0 | .0744 | 0 |
| 120 | 0 | .0186 | 0 | 0 | .0953 | .0093 |
| 150 | 0 | .0279 | 0 | 0 | .1186 | .0093 |
| 180 | 0 | .0326 | 0 | 0 | .1186 | .0093 |
| 210 | .00465 | .0395 | .0116 | 0 | .1302 | .0163 |
| 240 | .00930 | .0442 | .0163 | .00465 | .1348 | .0163 |
| 270 | .0139 | .0488 | .0209 | .00465 | .1465 | .0233 |
| 300 | .0267 | .0535 | .0302 | .00930 | .1512 | .0279 |
| 330 | .0372 | .0686 | .0453 | .0291 | .1616 | .0430 |
| 360 | .0418 | .0802 | .0546 | .0337 | .1773 | .0523 |
| 390 | .0418 | .0849 | .0546 | .0337 | .1733 | .0570 |
| 420 | .0512 | .0942 | .0639 | .0430 | .1872 | .0709 |
| 450 | .0512 | .1186 | .0639 | .0403 | .1953 | .0709 |
| 480 | .0558 | .1465 | .0733 | .0477 | .2047 | .0756 |
| 510 | .0580 | .1601 | .0847 | .0499 | .2064 | .0777 |
| 540 | .0603 | .1763 | .0870 | .0522 | .2111 | .0800 |
| 570 | .0638 | .1891 | .0905 | .0557 | .2193 | .0835 |
| 600 | .0661 | .2100 | .0951 | .0580 | .2355 | .0882 |
| 630 | .0696 | .2158 | .1021 | .0615 | .2413 | .0916 |
| Cell No. | 6 | 7 | 8 | 9 | 10 | 11 |
| Days | | | | | | |
| 660 | .0782 | .2274 | .1101 | .0689 | .2510 | .1002 |
| 690 | .0782 | .2320 | .1101 | .0689 | .2510 | .1002 |
| 720 | .0828 | .2358 | .1194 | .0735 | .2557 | .1049 |
| 750 | .0944 | .2506 | .1263 | .0805 | .2626 | .1118 |
| 780 | .0944 | .2506 | .1287 | .0805 | .2626 | .1142 |
| 810 | .1014 | .2599 | .1310 | .0852 | .2650 | .1165 |
| 840 | .1014 | .2622 | .1333 | .0852 | .2650 | .1188 |
| 870 | .1084 | .2668 | .1391 | .0933 | .2661 | .1246 |
| 900 | .1176 | .2761 | .1484 | .1026 | .2730 | .1316 |
| 930 | .1200 | .2769 | .1484 | .1072 | .2730 | .1362 |
| 960 | .1246 | .2807 | .1530 | .1072 | .2777 | .1408 |
| Total Lbs./ft.$^2$ | .1246 | .2807 | .1530 | .1072 | .2835 | .1455 |
| Lbs./ft.$^2$-week | .00089 | .00202 | .00110 | .00077 | .00204 | .00105 |

As shown at Point A, FIG. 19, the average sodium chlorate content of the anolyte liquor in the eleven-unit cell began to rise near the 29th day. Analysis of the sodium chlorate content of the individual cell units indicated that Cell No. 10 had a higher sodium chlorate content in the anolyte liquor of this cell and asbestos addition to Cell No. 10 was begun. Thereafter, the average sodium chlorate content of the anolyte liquor remained fairly steady at about 0.04 to 0.05 percent until the about 84th day (Point B), at which time it began again to rise to the 105th day (Point C). Asbestos addition to Cell No. 4 was begun on the 96th day and asbestos addition to Cells Nos. 3, 7, and 11 was begun on the 107th and 108th days. By the 111th day (Point D), the average chlorate content of the anolyte liquor of the eleven-unit cell had dropped from approximately 0.08 to approximately 0.06 percent. At approximately the 133rd day (Point E), the chlorate content began to rise and continued to rise to approximately the 147th day (Point F). Asbestos addition to Cell No. 5 was begun on the 120th day and to Cell No. 2 on the 140th day. Addition of asbestos to Cell No. 1 was begun on the 175th day, to Cell No. 8 on the 190th day, to Cell No. 6 on the 198th day and to Cell No. 9 on the 238th day. Once started, asbestos additions to each cell were continued as indicated by the sodium chlorate content of the anolyte for each cell. From approximately the 225th day (Point G) to the 320th day (Point H), the average sodium chlorate content of the anolyte liquor of the eleven-unit cell remained approximately steady between 0.045 and 0.07 percent. During the week, between approximately the 320th day and the 329th day (Point I), the average sodium chlorate content of the anolyte liquor went up to about 0.19 percent (all on the anhydrous basis). From the 574th day (Point J) until the 602nd day (Point K), the chlorate content of the anolyte liquor was above about 0.20 weight percent, anhydrous basis. During this time, the rate of asbestos addition was increased, especially to cells 5, 7, and 11. By the end of this period, the anolyte liquor chlorate content was reduced to about 0.18 weight percent, anhydrous basis. The anolyte liquor chlorate content was maintained below about 0.20 weight percent, anhydrous basis, until the 966th day, when it was again necessary to add asbestos.

By continued monitoring of each cell unit and continued addition of asbestos to the cells as indicated by the sodium chlorate content of the cell liquor from each cell, the average sodium chlorate content of the cell liquor from the eleven-unit cell was kept at about 0.1 percent or below for a period of 966 days, with high current efficiency throughout this period, at which time this test was terminated.

Similar monitoring of the hydrogen concentration in the chlorine gas will give similar information and will provide a check on the efficiency of the sodium chlorate monitoring.

By applying similar monitoring to cells equipped with membrane diaphragms and the addition of membrane material to the circulating cell liquor as necessary, the performance of membrane diaphragms may be continued at an approximately steady efficiency and high current efficiency.

The embodiments of the invention shown are for illustrative purposes only and various modifications and changes may be made within the spirit and objects of this invention. The cells illustrated may be used as unipolar single cells or as bipolar multiple cells, and while titanium and steel have been described as the preferred metals of construction, any valve metal or film-forming metal may be used for the anodic portions and any ferrous metal may be used in the cathodic portions of the cells and various dissimilar metals may be used for the anodic and cathodic portions of the cell units. Examples of other suitable anode metals are lead, silver and alloys thereof and metals which contain or are coated with $PbO_2$, $MnO_2$, $Fe_3O_4$, etc., and examples of other suitable cathode metals are copper, silver, stainless steel, etc. The metals and plastics used should be suitable to resist the corrosive or other conditions encountered in the anode and cathode compartments and other portions of the cells when operating on a particular electrolyte. While diaphragms on the cathodes will usually be used, diaphragms may be used on both anodes and cathodes. When non-porous ion-selective membranes are used as diaphragms, a continuous recycling of at least a portion of the anolyte and of the catholyte must be provided in order to keep the concentrations of both the anolyte and of the catholyte constant. The cathode structures are preferably made exactly as the anode structures, thus providing two recirculation spaces behind the walls supporting the electrodes so that the gas liberated on the electrodes flows upwards in the central portion of the cell compartment and part of the electrolyte brought to the top of the compartment is recirculated to the bottom of the compartment through the spaces behind the two walls formed respectively by the assembly of the anode support bars and by the assembly of the cathode support bars.

I claim:

1. The method of providing anolyte recirculation in a diaphragmtype electrolysis cell in which gas is evolved at the anode, which comprises operating the cell with a flooded anolyte compartment communicating with an overhead brine feed tank by at least one flooded vertical conduit leading from the top of the anolyte compartment to the top portion of said feed tank causing the anolyte to rise by the gas lift effect of the gas bubbles and to circulate upwardly along the diaphragm, and recirculating the liquid anolyte from the anolyte compartment through another flooded conduit leading from said feed tank to the anolyte compartment, adding diaphragm material to said circulating electrolyte, passing a portion of said electrolyte through the diaphragm and depositing a portion of the added diaphragm material on said diaphragm.

2. The method of claim 1, in which the diaphragm material is added to said circulating electrolyte in said feed tank.

3. The method of providing anolyte recirculating within the anolyte compartment in a diaphragm-type electrolysis cell in which gas is evolved at the anode, which comprises operating the cell with a substantially flooded anolyte compartment, providing a vertical partition in said anolyte compartment extending from a short distance from the bottom of the compartment to a short distance from the top of the compartment, which partition defines a front portion of the compartment housing the anodes and a rear portion behind said vertical partition, causing the anolyte to rise along the diaphragm in said front portion by the gas lift effect of the gas bubbles, recirculating the anolyte from the top to the bottom of the anolyte compartment through said rear portion of the compartment, adding additional diaphragm material to the recirculating electrolyte, and passing a portion of the electrolyte through said diaphragm to deposit additional diaphragm material on said diaphragm.

4. The method of claim 3, in which the additional diaphragm material is added when the chlorate content of the anolyte increases.

5. The method of providing anolyte recirculation in a diaphragmtype electrolysis cell in which gas is evolved at the anode, which comprises operating the cell with a flooded anolyte compartment communicating with an overhead brine tank by at least one flooded substantially vertical conduit leading from the top of the anolyte compartment to substantially the level of the electrolyte in said brine tank, causing the anolyte to rise in said conduit by the gas lift effect of the gas bubbles, recirculating the anolyte from the bottom of said brine tank to the anolyte compartment through another flooded conduit leading from said feed tank to the anolyte compartment, adding additional diaphragm material to the recirculating anolyte, and passing portion of the anolyte through the diaghragm to deposit additional diaphragm material on the diaphragm.

* * * * *